US005967202A

United States Patent [19]

Mullen et al.

[11] Patent Number: 5,967,202

[45] Date of Patent: Oct. 19, 1999

[54] APPARATUS AND METHOD FOR DISPENSING A SANITIZING FORMULATION

[75] Inventors: Richard V. Mullen, Cottage Grove; Scott P. Bennett, Stillwater; Steve E. Pasek, Shoreview; Cathy M. Paquette, Minneapolis, all of Minn.; David R. Strehlow, Hales Corners, Wis.

[73] Assignee: Ecolab Inc., St. Paul, Minn.

[21] Appl. No.: 08/869,782

[22] Filed: Jun. 5, 1997

[51] Int. Cl.[6] ..... B65B 1/04

[52] U.S. Cl. ..... 141/104; 141/18; 141/2; 222/160

[58] Field of Search ..... 141/231, 104, 141/18, 2, 9; 222/160, 135, 129, 608

[56] References Cited

U.S. PATENT DOCUMENTS

| | | |
|---|---|---|
| 3,728,449 | 4/1973 | Cantor et al. . |
| 3,993,777 | 11/1976 | Caughman et al. . |
| 4,049,830 | 9/1977 | Pugliese . |
| 4,199,602 | 4/1980 | Lentsch . |
| 4,258,056 | 3/1981 | Lentsch . |
| 4,311,709 | 1/1982 | Dyhas et al. . |
| 4,376,787 | 3/1983 | Lentsch et al. . |
| 4,641,693 | 2/1987 | Rakucewicz . |
| 4,732,181 | 3/1988 | Sollander et al. . |
| 4,983,643 | 1/1991 | Sanas, Jr. . |
| 5,056,686 | 10/1991 | Jarrett . |
| 5,063,249 | 11/1991 | Andrews . |
| 5,139,788 | 8/1992 | Schmidt . |
| 5,154,314 | 10/1992 | Van Wormer . |
| 5,193,720 | 3/1993 | Mayberry . |
| 5,195,966 | 3/1993 | Corby . |
| 5,203,366 | 4/1993 | Czeck et al. . |
| 5,234,035 | 8/1993 | Neeser . |
| 5,261,353 | 11/1993 | Stevenson . |
| 5,308,868 | 5/1994 | Kefford . |
| 5,370,815 | 12/1994 | Kessler . |
| 5,503,838 | 4/1996 | Schmidt et al. . |
| 5,534,266 | 7/1996 | Ricketts . |
| 5,597,019 | 1/1997 | Thomas et al. ..... 141/104 |

OTHER PUBLICATIONS

MAXXUM™ brochure, Ecolab® Food & Beverage Divison, ©1997 Ecolab Inc., 8 pages.

Optima Dispensing System brochure, Klenzade®, A Service of Ecolab®, ©1992 Ecolab Inc., 2 pages.

Optima® Systems for Teat Dip Concentrates product series brochure, Klenzade®, A Service of Ecolab®, ©1993 Ecolab Inc., 4 pages.

Quantum® brochure, Klenzade®, A Service of Ecolab®, undated, 8 pages, (No date available).

Tru–Feed System, Animal Health Services, Jacksonville, FL, product brochure, undated, 9 pages, (No date available).

Advertisement, "Chemical Blending System #248", Gardner Machinery Corp., at top of page of Oct. 1995 edition of unknown publication.

*Primary Examiner*—Steven O. Douglas

*Attorney, Agent, or Firm*—Merchant & Gould P.C.

[57] ABSTRACT

An automatic dispensing method and apparatus for transporting separate concentrated chemicals to the site of use and then dispensing the concentrated chemicals into a storage container to create a final or intermediate composition. The automatic dispensing apparatus includes a computer program that calculates the appropriate formulation and then interfaces with a controller to cause the appropriate chemical concentrates and the appropriate volumes of those concentrates to be dispensed. A method of generating a desired formulation is also disclosed and claimed.

52 Claims, 12 Drawing Sheets

FIG. 2
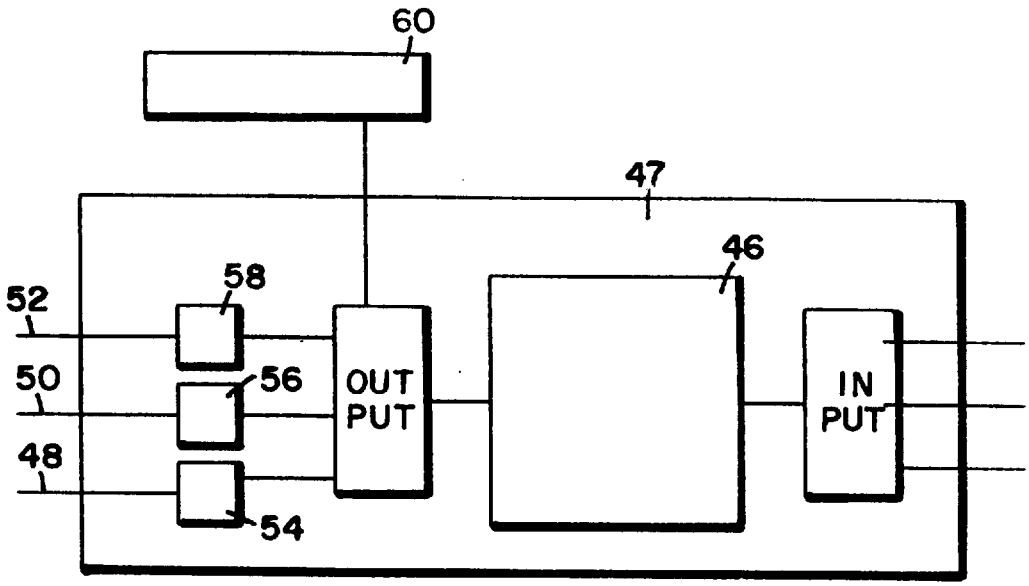
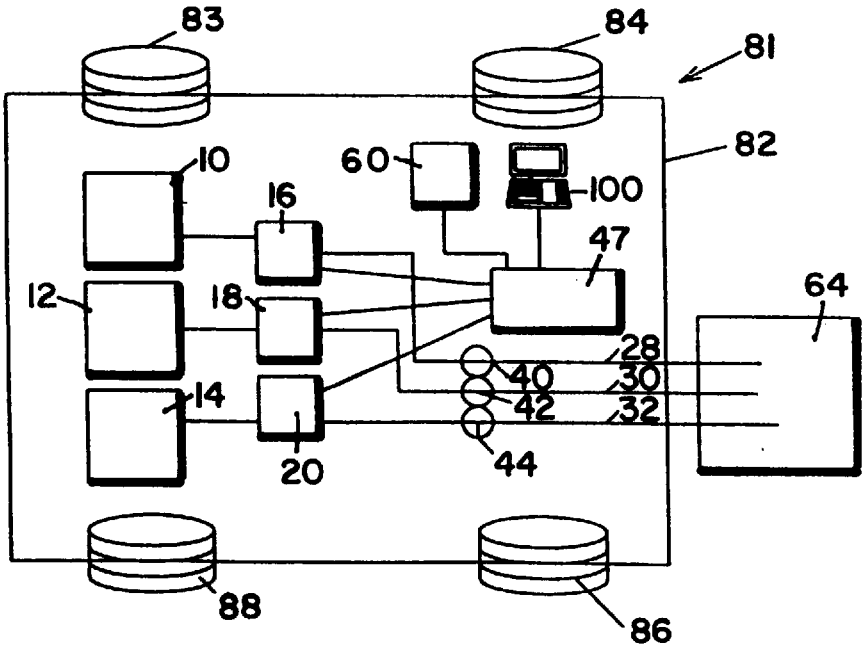
FIG. 3

APPARATUS AND METHOD FOR DISPENSING A SANITIZING FORMULATION

FIELD OF THE INVENTION

The invention relates generally to a method and apparatus for dispensing sanitizing and cleaning formulas. More specifically, the invention relates to a method and apparatus for transporting chemical concentrates to a site of use, generating a formula, and dispensing the formula at the site of use.

BACKGROUND OF THE INVENTION

In the typical manufacture of sanitizing compositions, the ingredients are blended in large mixing vessels, packaged into disposable plastic containers and shipped via sales distribution channels to the end user, often hundreds of miles distant from the source facility. These products often sit for months within the distribution system prior to delivery and application. Due to this aging, the chemistries that can be utilized within these compositions are limited to those having long shelf life stability. Therefore, many other admixtures and ingredients cannot be used (e.g., superior antimicrobial agents having limited shelf life).

A number of prior art methods include the transportation of fluids for mixing and distribution at the point of use. Van Wormer, U.S. Pat. No. 5,154,314, discloses a chemical dispenser on a vehicle which dispenses fluids at the site of use. Rakucewicz, U.S. Pat. No. 4,641,693 also discloses a dispensing apparatus which delivers a plurality of syrups for use in soft drinks concurrently from a truck.

Sollander et al., U.S. Pat. No. 4,732,181, discloses an apparatus for dispensing a foamed camouflage material for application to the ground or to fill containers which cover a vehicle. The foaming apparatus is attached to a vehicle for easy transportation or for camouflage of that vehicle. A water based foaming liquid passes through a housing where air is blown via a fan and the liquid is ejected through a nozzle resulting in a foamed material. Dyes are added to obtain the desired camouflage pattern. Sollander et al. uses an automatic coloring control means enabling a continuous adjustment of the color of the foam to that of the surroundings. The color control means includes photometers. A signal is fed back from the photometers to a computer, which in response to the comparison of these colors, controls the supply of different coloring agents to the foaming liquid.

U.S. Pat. No. 5,193,720 to Mayberry discloses a vehicular dispensing apparatus for dispensing two part coating compositions such as paints. The vehicle is a portable cart. The two or more coating compositions are delivered to the site of use separately on the cart and then mixed at the site of use. Computer control is provided for the mixing and dispensing operations including custom formulations and quantities.

U.S. Pat. No. 5,203,366 to Czeck et al. discloses an apparatus for dispensing chemical concentrates at a point of use. The apparatus includes an axial manifold having a plurality of inlet ports extending radially toward the center of the manifold. Control valves are located at the inlet ports to control the supply of chemical concentrates into the manifold and the chemicals are drawn into the manifold by operation of a positive displacement pump. The chemical concentrates are mixed at a filling station. A microprocessor controller manages the operation of the dispensing apparatus and receives information from a flowmeter situated downstream of the manifold. The apparatus may be used to form dilute aqueous chemical compositions, or mixtures of chemical concentrates without added water.

However, these patents do not teach the transport of liquid compositions which may then be mixed at the point of use, especially liquids that may be either incompatible when mixed or have a short shelf life once mixed.

There is a need in the art for a method and apparatus for transporting concentrated chemicals to a site of use separately, determining the composition required at that specific site of use, mixing the concentrated chemicals to arrive at the determined composition, and delivering the determined composition to the site of use.

SUMMARY OF THE INVENTION

The present invention provides a robust method and apparatus for dispensing a final composition at a point of use. The principles of the invention include transporting a plurality of concentrated chemical compositions to the point of use using a vehicle having a plurality of concentrate containers disposed thereon, wherein each concentrate container stores one of the plurality of concentrated chemical compositions; determining a desired formulation of a composition, the desired formulation specifying predetermined quantities of at least one of the concentrated chemical compositions and a carrier; and generating and delivering the desired formulation to the point of use. It will be appreciated that such desired formulation may be a final composition or an intermediate composition.

This invention also includes a vehicle-mounted dispensing apparatus for dispensing a final composition at a point of use, the apparatus including a plurality of concentrate containers mounted on a delivery vehicle, each concentrate container housing a concentrated chemical composition for use in the formulation of a final composition; at least one delivery mechanism coupled in fluid communication with the plurality of concentrate containers to selectively deliver a metered quantity of each concentrated chemical composition to a storage container at the point of use; and a controller configured to activate the delivery mechanism to deliver a desired formulation of final composition having predetermined quantities of at least two of the concentrated chemical compositions.

An exemplary application of the invention is an apparatus for incorporating-into a carrier fluid varying concentrations of ingredients which comprise bovine mastitis prevention and control treatments. The invention lends itself to the preparation of a plurality of mastitis treatment admixtures, each being designed to meet the mastitis control needs of a targeted herd.

The invention also includes a method of generating a desired formulation of a final composition including the steps of receiving input designating a particular formulation, receiving input designating the desired amount of formulation to be dispensed, outputting commands to a controller designating the amount of each of +the concentrated chemical composition(s) to dispense, and outputting a command to the controller to begin dispensing operations.

While the invention will be described with respect to a preferred embodiment, it will be understood that the invention is not to be construed as limited in any manner by either such configurations or components described herein. The various advantages and features which characterize the invention are pointed out with particularity in the claims annexed hereto and forming a part hereof. However, for a better understanding of the invention, its advantages and objectives obtained by its use, reference should be had to the drawing which forms a further part hereof and to the accompanying descriptive matter, in which there is illustrated and described a preferred embodiment to the invention.

BRIEF DESCRIPTION OF THE DRAWING

Referring to the drawing, wherein like numerals represent like parts throughout the several views:

FIG. 2 is a functional block diagram of the controller 46 used by block 47 of FIG. 1.

FIG. 3 is a top view of the apparatus of the invention on a delivery vehicle.

DETAILED DESCRIPTION

As noted above, the principles of the present invention apply to the transportation of concentrated chemicals to a site of use. Once at the site of use, the product composition is determined, the product composition is generated and delivered to the site of use. While the present invention will be described in connection with the exemplary application of bovine teat dips, it will be appreciated that such application is typical of only one of innumerable types of applications in which the principles of the present invention can be employed.

In order to more fully describe the present invention, an overview of the system components comprising an apparatus constructed in accordance with the principles of the present invention will first be presented. Second, the computer hardware environment will then be described. Third, a description of the allocation elements and operation thereof is provided. Finally, a working example of the device in operation will be presented in accordance with an exemplary application in which the principles of the present invention might be employed.

a. System Components and Overview

Figure 1:
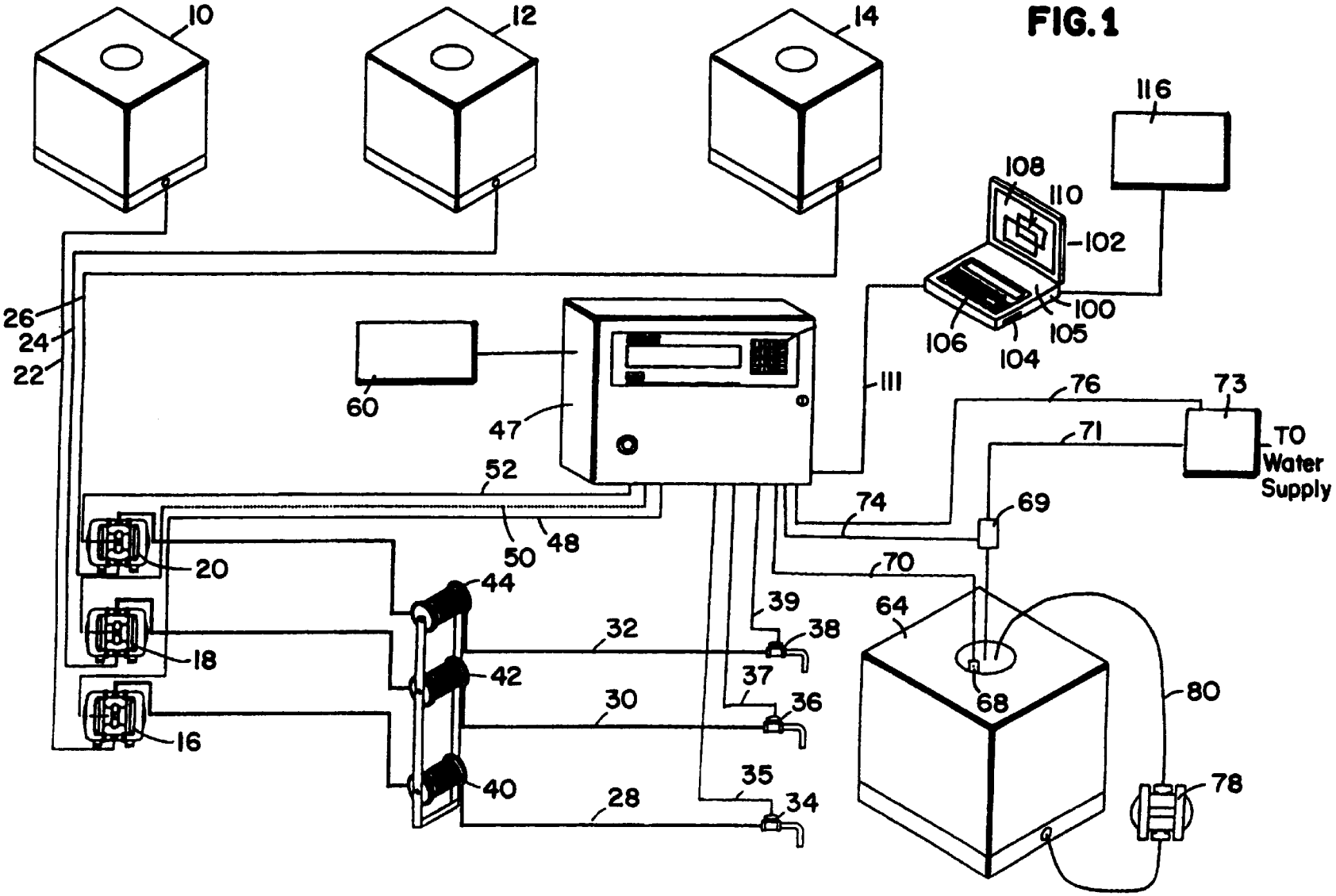
FIG. 1 is a schematic diagram illustrating the functional components of an apparatus constructed in accordance with the principles of the present invention together with exemplary concentrated chemicals.

Turning first to FIG. 1, there is illustrated a schematic diagram of the dispensing apparatus of this invention. Three concentrate containers 10, 12 and 14 contain chemical concentrates are shown. However, it will be appreciated that other numbers of containers may be provided as desired and/or required for the environment in which the dispenser apparatus is employed. Exemplary chemical concentrates carried by the containers 10, 12 and 14 include iodine premix, glycerine premix and sorbitol premix respectively. The containers 10, 12 and 14 are preferably constructed of a material which is rugged for transporting the chemicals and which does not interact with the chemical concentrates utilized in that environment. Accordingly, various metals and plastics may be used in differing environments. Similarly volumes of chemical concentrates carried by the containers 10, 12, and 14 may vary as required by the environment, and each of the containers may be sized differently. In the preferred embodiment used in connection with the exemplary application, the containers 10, 12, and 14 are constructed of polyethylene, and have a volume of zero to three thousand (0–3000) gallons.

The three concentrate containers 10, 12 and 14 are each connected to a fluid transport means. In the preferred embodiment, the fluid transport means is comprised of three T-stroke M-1 pumps 16, 18 and 20 and hoses 22, 24 and 26 respectively. The pumps 16, 18 and 20 are double diaphragm air driven pumps with a volume of seven (7.0) ounces per stroke. It will be appreciated, however, that the pumps 16, 18 and 20 can include both time based pumps and/or pulse type pumps. For example, the resolution of the pumps can be 0.1 second resolution for time based pumps and ON and OFF times to 0.1 second resolution.

The pumps 16, 18 and 20 transport the concentrate through hoses 28, 30 and 32, respectively, to solenoid valve fill spouts 34, 36 and 38. The solenoid valve spouts 34, 36 and 38 are responsive to control signals (e.g., the operation of the spout may be controlled by electrical signals). A controller device 47 provides these signals via lines 35, 37 and 39 respectively. The lines 35, 37 and 39 can be, for example, electrical wires. The hoses 28, 30 and 32 may be stored on hose reels 40, 42 and 44 respectively.

In the preferred embodiment, the controller device 47 may be a controller of the type manufactured by the Assignee of the present invention under the designation SABRE™. Such controller device 47 includes an input pad and a lighted display for user operation and user customized programming. The device 47 also includes a plurality of input and output lines to a processor block 46 (best seen in FIG. 2 and described below). The processor block 46 is comprised of a programmable processor chip of the microprocessor type.

Referring now to FIGS. 1 and 2, the three pumps 16, 18 and 20 are controlled by the processor block 46. The controller device 47 is connected to the three pumps 16, 18 and 20 by pneumatic air lines 48, 50 and 52, with a plurality of solenoids 54, 56 and 58 coupled between a pressure source 60 and the pneumatic air lines 48, 50 and 52 respectively. In operation, the processor 46 (in response to commands from a computer program 110 operating on computer 100; described below) activates a pump 16, 18 or 20 for a predetermined period of time to fluidly transfer the associated chemical concentrate from the concentrate container 10, 12 or 14 to the valve spout 34, 36 or 38 at the site of use (e.g., a storage container 64). The processor 46 generates signals to open the valve spouts 34, 36 and 38 while the associated pumps 16, 18 and 20 operate.

The storage container 64 preferably includes a gauge for indicating to an operator and/or user the amount of liquid in the storage container 64. One or more sensors 68 may also be placed in the storage container 64. A feedback path 70 connects the sensors 68 to the processor 46 to provide processing information. The sensors 68 can be pH sensors, ion sensors, temperature sensors, or conductivity sensors each of which are well known in the art. It will be appreciated that other sensors might also be used to provide information to the processor 46. The processor 46 utilizes the feedback signal from the sensors 68 to adjust its control of the pumps 16, 18 and 20 to insure that the desired quantities of chemical concentrates are dispensed.

A carrier (such as water or other diluent) is dispensed into the storage container 64 through hose 71. The correct volume is dispensed by one of two methods. First, the computer program running as the operator interface block 112 (best seen in FIG. 3 and described further below) can instruct the operator to manually dispense the appropriate volume of water. Alternatively, a valve 73 in the hose 71 can be controlled by the controller 47 via line 76. In the latter embodiment, a flow sensor 69 may be operatively provided in the hose 71. The flow sensor 69 is connected to the processor 46 by a feedback signal path 74.

A pump 78, preferably of the T-stroke M-2 type, recirculates the mixed composition in storage container 64 via hose 80 to reduce any settling and to ensure complete mixing of the concentrate chemicals being dispensed within the storage container 64. It should be appreciated that any mixing apparatus may be used such as, for example, a mixing pump tube.

Preferably, the components comprising the invention are located on a vehicle (such as a truck) in order to transport, determine and dispense the final solution at the site of use. FIG. 3 functionally illustrates the various components of the present invention located on such a vehicle 81. The vehicle 81 is shown as including wheels 83, 84, 86 and 88 and frame 82. The components shown in FIG. 3 as being arranged and configured within the frame 82 are operatively mounted on the frame 82 in order to be transportable/mobile. However, the exact arrangement of the components in FIG. 3 is not meant to be limiting. It will be appreciated that many arrangements are possible which result in the advantages of this invention.

As noted above, the chemical concentrates flow from the hoses 28, 30 and 32 and into the storage container 64 to mix and result in a final composition. While the storage container 64 is not illustrated shown on the vehicle 81, it could also be mounted on vehicle 81.

b. Computer Hardware Environment

FIG. 1 also illustrates an exemplary computer hardware environment for the present invention. The present invention is preferably implemented using a personal laptop computer 100 (i.e., a personal computer having a Pentium™ chip or equivalent). However, it will be appreciated that computer 100 may be another type of computer, including a special purpose computer. It is envisioned that computer 100 includes a monitor 102, floppy disk drive 104 and/or hard drive 105. Also included in the preferred embodiment may be input devices, for example, a keyboard 106 and/or pointing device (not shown). The computer 100 can also be connected to an output device such as printer 116.

The computer 100 operates under the control of an operating system 108 (for example the WINDOWS™ operating system), which is represented in FIG. 1 by the screen display on the monitor 102. The present invention is preferably implemented using one or more computer programs 110, which are represented in FIG. 1 by the "windows" displayed on the monitor 102, operating under the control of the operating system 108.

Generally, the computer programs 110 are tangibly embodied in a computer-readable medium, e.g. one or more of the fixed and/or removable data storage devices 104. Under control of the operating system 108, the computer programs 110 may be loaded from the data storage devices 104 into the memory of the computer 100. The computer programs 110 comprise instructions which, when read and executed by the computer 100, causes the computer 100 to perform the steps necessary to execute the steps or elements of the present invention. Also as shown in FIG. 1, the computer 100 is electrically connected to the controller 46 by an RS-232 serial link 111.

Those skilled in the art will recognize that the exemplary environment illustrated in FIG. 1 is not intended to limit the present invention. Indeed, those skilled in the art will recognize that other alternative hardware environments may be used without departing from the scope of the present invention.

c. Mobile Allocation Controller (MAC) Operations

Figure 4A:
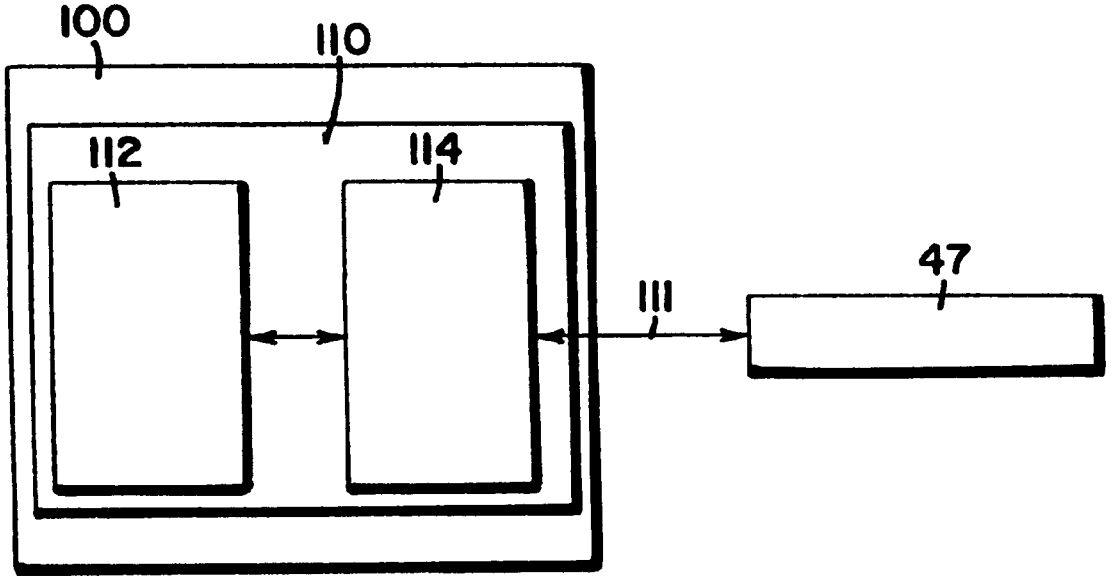
FIG. 4A is a functional block diagram of the computer hardware, the software interfaces, and the connection thereof to the controller block 46 of FIG. 2.

FIG. 4 illustrates a functional block diagram of the Mobile Allocation Controller (MAC) of the invention. In the preferred embodiment, the MAC includes three functional elements. It will be appreciated, however, that such functional elements do not necessarily need to be separate. For example, the functionality may be combined in hardware and/or software to arrive at a differing number of functional elements.

The first element is the Operator Interface programming block 112. The Operator Interface 112 is a portion of the computer program 110 which guides the operator through all available delivery options. In the preferred embodiment, the Operator Interface 112 program is written in Visual Basic. It also provides access to setup information using a password protection method.

The second element is the SABRE™ Interface programming block 114. This element is another computer program 110, but this element is "invisible" to the operator and setup person. The SABRE™ Interface 114 communicates with the Operator Interface 112 using DDE protocol which is a standard communications protocol. DDE communications is accomplished using Visual Basic text boxes with assigned Topic names. Each box contains one numeric value. About half the boxes are used for communication from the operator interface 112 to the SABRE™ interface 114. The remaining codes provide information back to the operator interface block 112. The following table 1 describes the boxes and their uses:

TABLE 1

| Topic Name | Description |
|---|---|
| R1C1 | Command Send - Command from the Operator Interface to the SABRE ™ Interface |
| R2C1–R9C1 | Chemical Amount - Values passed to the SABRE ™ Controller in ON seconds or pulse counts for each pump |
| R1C2 | Command Response - Status response from the SABRE ™ Interface to the Operator Interface |
| R2C2–R9C2 | Actual Chemical Amount - Values returned by the SABRE ™ controller indicating current activity on the pump outputs |
| R10C1 | Water Amount - Value passed to the SABRE ™ Interface indicating how much water is required |
| R10C2 | Actual Water Amount Value returned by the SABRE ™ controller indicating current water added |

The controller 47 communicates with the SABRE™ Interface 114 via RS-232 serial link 111. The purpose of the SABRE™ Interface 114 is to receive commands from the operator interface 112 and, in response thereto, to send commands to the controller 47 and to receive information from the controller 47 and pass that information back to the operator interface 112.

Figure 4B:
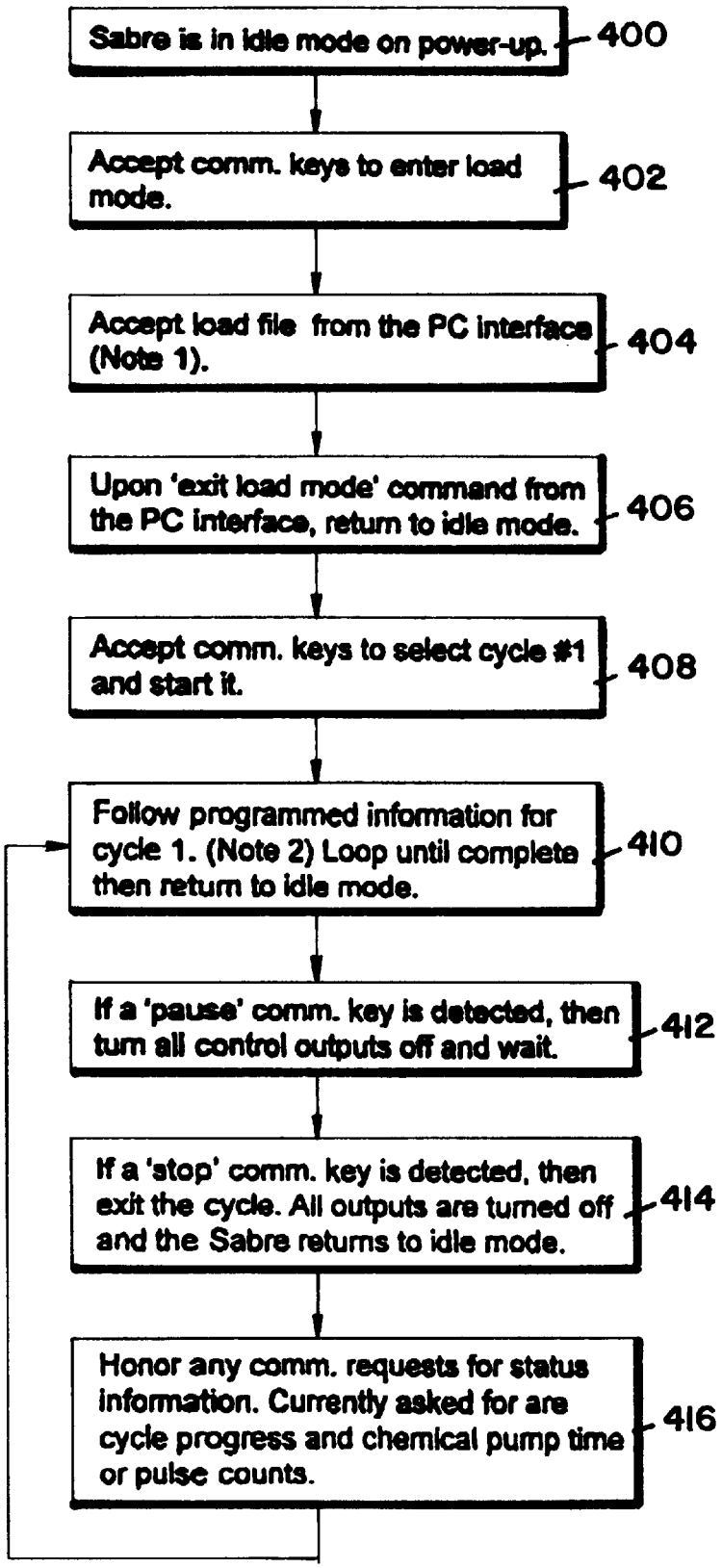
FIG. 4B is a logic flow diagram illustrating the programming steps implemented by the controller block 46.

The third element of the MAC is the controller 47 described above. FIG. 4B illustrates the logical programming steps of the actions of the controller 47—as it functions as part of the MAC. It will be appreciated that while the controller 47 is described herein as actively waiting or operating in various functional manners, the processor 46 is implementing programming steps based on various input and output to achieve the desired functional results.

First, at power up the controller 47 is in idle mode as represented by block 400. In idle mode the outputs of the controller 47 are all off and the controller 47 is waiting for operator action. Block 402 represents the controller 47 accepting communication keys from the SABRE™ interface 114 to enter "load mode" (communication keys are keys sent via the RS-232 communications port). Load mode is a mode in which the controller 47 is waiting to accept ASCII text load files containing programming for the controller 47. Block 404 represents the controller 47 accepting a load file from the SABRE™ interface 114. All control features of the controller 47 are available at load time. Block 406 represents the controller 47 responding to a "exit load mode" command from the SABRE™ interface 114 by returning to idle mode.

At block 408 the controller 47 accepts communication keys to select and start cycle #1. Cycle #1 is a combination of pump on and off times generating a total run time expressed in minutes and seconds. Moving to block 410, the controller 47 begins to follow the programmed information for cycle #1. For example, pumps 16, 18 and 20 are cycled for the appropriate time based on the logic information loaded during the "loading" process as represented by block 404. At block 412 the controller 47 checks whether a "pause" communication key is detected and, if one is detected, turns all control outputs off and waits. The control outputs are outputs controlled by programming in the controller 47 (e.g., pneumatic air lines 48, 50 and 52; control lines 35, 37 and 39; and control line 76). At block 414 the controller 47 checks whether a "stop" communication key is detected and, if one is detected, exits the cycle, turning all control outputs off and returning to idle mode.

At block 416 the controller 47 responds to any communication requests for status information. For example, the operating interface 112 (via the SABRE™ interface 114) may request information from the controller 47 about cycle progress and pump time or pulse counts. After block 416, the controller 47 returns to block 410 to continue the loop through blocks 410, 412, 414 and 416 until the cycle is completed at which time the controller 47 returns to idle mode.

As part of the MAC, the hard drive 105 and/or a diskette in the floppy drive 104 (or any other storage medium electrically coupled to the computer 100) contains three databases: a Customer Database, a Formula Database and a Delivery History Database. These databases are preferably defined in the Access™ database software by Microsoft Corporation. The databases include information for the computer program 110. The Customer Database stores names of customers as well as a list of assigned formulations for each customer. The Formula Database contains the chemical concentrate proportions for each formulation. The Delivery History Database stores historical information about the amount and kind of formulation delivered to each customer.

Figure 5A:
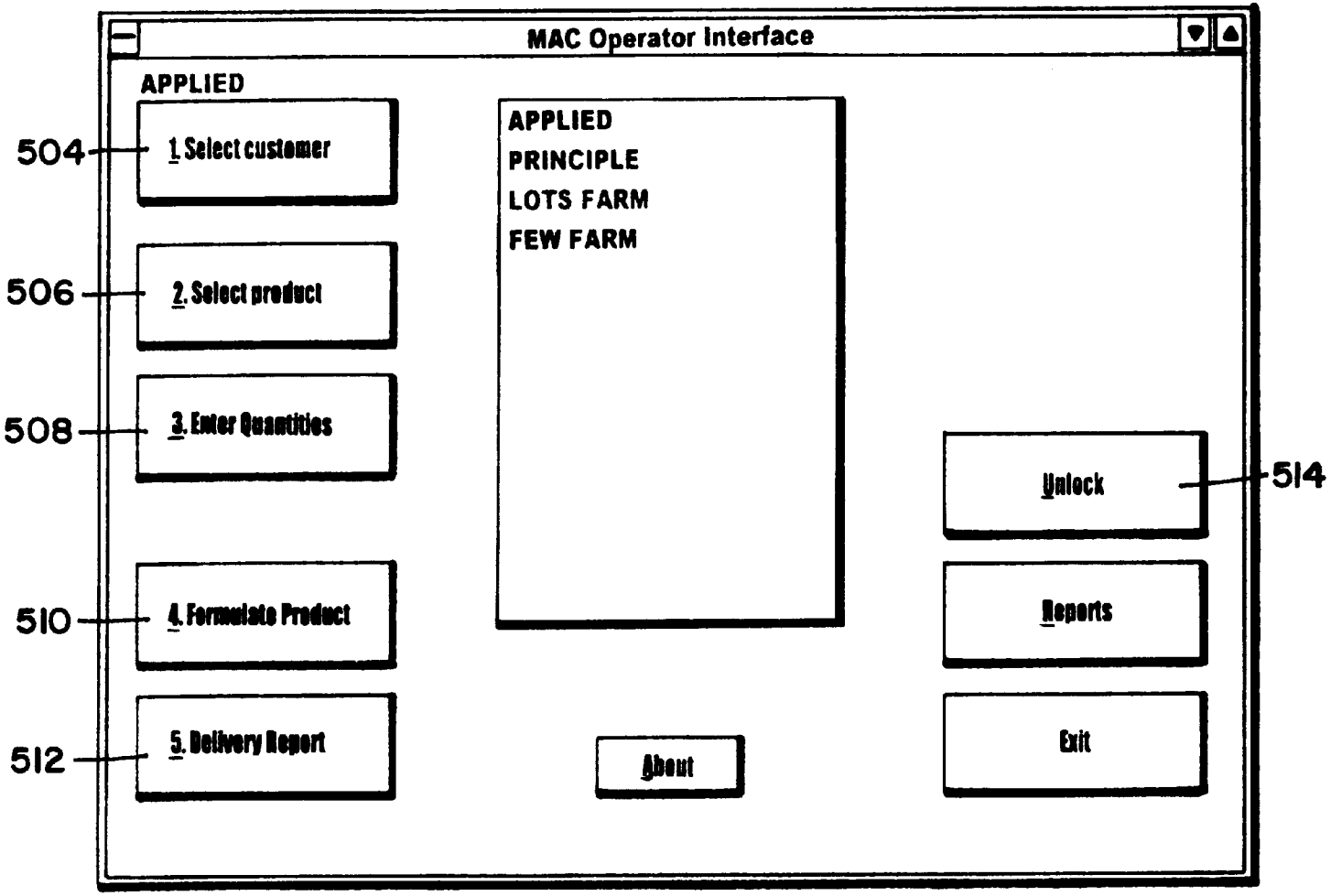
FIG. 5A illustrates the user interface screen display initially generated by operator interface programming block 112 during operation.

In operation of the MAC, all operation starts from an initial screen on the monitor 102. FIG. 5A illustrates this initial screen. The boxes labeled 504–514 represent virtual buttons which can be activated by the operator as is well known in the art. The screen layout is presented to allow the operator to do formulations with a minimum amount of knowledge about personal computer operation. In the preferred embodiment, the steps that the operator must follow appear on the screen as numbered buttons that must be done in numerical sequence.

It should be noted that the interface between the computer 100 and the user can be in any form, such as virtual buttons, a keyboard 106, a touchscreen or any other method known in the computer arts. As noted above, a "mouse" type input device may be included in addition to (or in lieu of a keyboard). Accordingly, the use of virtual buttons throughout this specification is not meant to limit the invention.

From the screen shown in FIG. 5A an operator may follow two paths. The first path is a "SETUP OPERATIONS" path. This path would normally be used by a person establishing the functionality of the MAC, and would generally be performed at an office or plant location. The "SETUP OPERATIONS" path is selected by the operator by activating the "Unlock" button 514 and entering a second level passcode. The second path is the "FIELD OPERATION" path. This latter path would be used by the person actually formulating the finished products at the customer location (e.g., the site of use). The "FIELD OPERATION" path is selected when the operator selects in order, the buttons numbered 504–512.

The first path, SETUP OPERATIONS path, generally involves the following steps. The operator selects the "Unlock" button 514. Next, the screen (shown in FIG. 5B) appears on the monitor. In the preferred embodiment, the computer program 110 then prompts the user for either a level 1 password or a level 2 password. Based on the response by the user, either level 1 or level 2 access is granted.

Figure 5B:
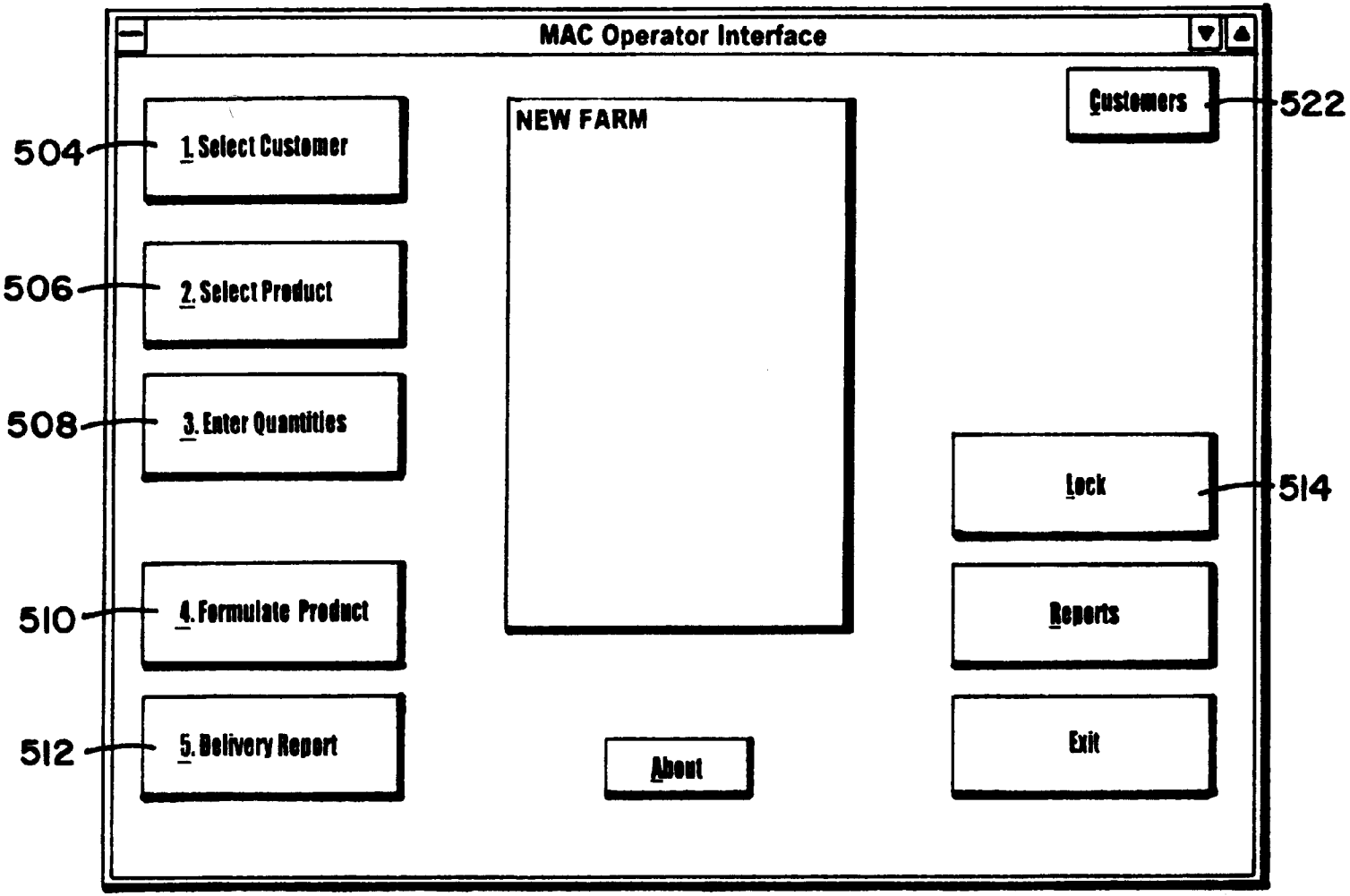
FIG. 5B illustrates the user interface screen generated by the operator interface program 112 after level 1 (low level) passcode has been entered and accepted.

If level 1 access is granted, then the screen shown in FIG. 5B appears on the monitor and the user is allowed to edit the customer list on the customer database. The setup person with level 1 access can also initiate transfer of the delivery history stored on the hard drive 105 to a floppy disk in the floppy drive 104. The data is stored on the diskette in a format that can be read by a database or spreadsheet program. The capability of transferring delivery history files directly to database or spreadsheet programs allows for automated preparation of billing documents.

Figure 5C:
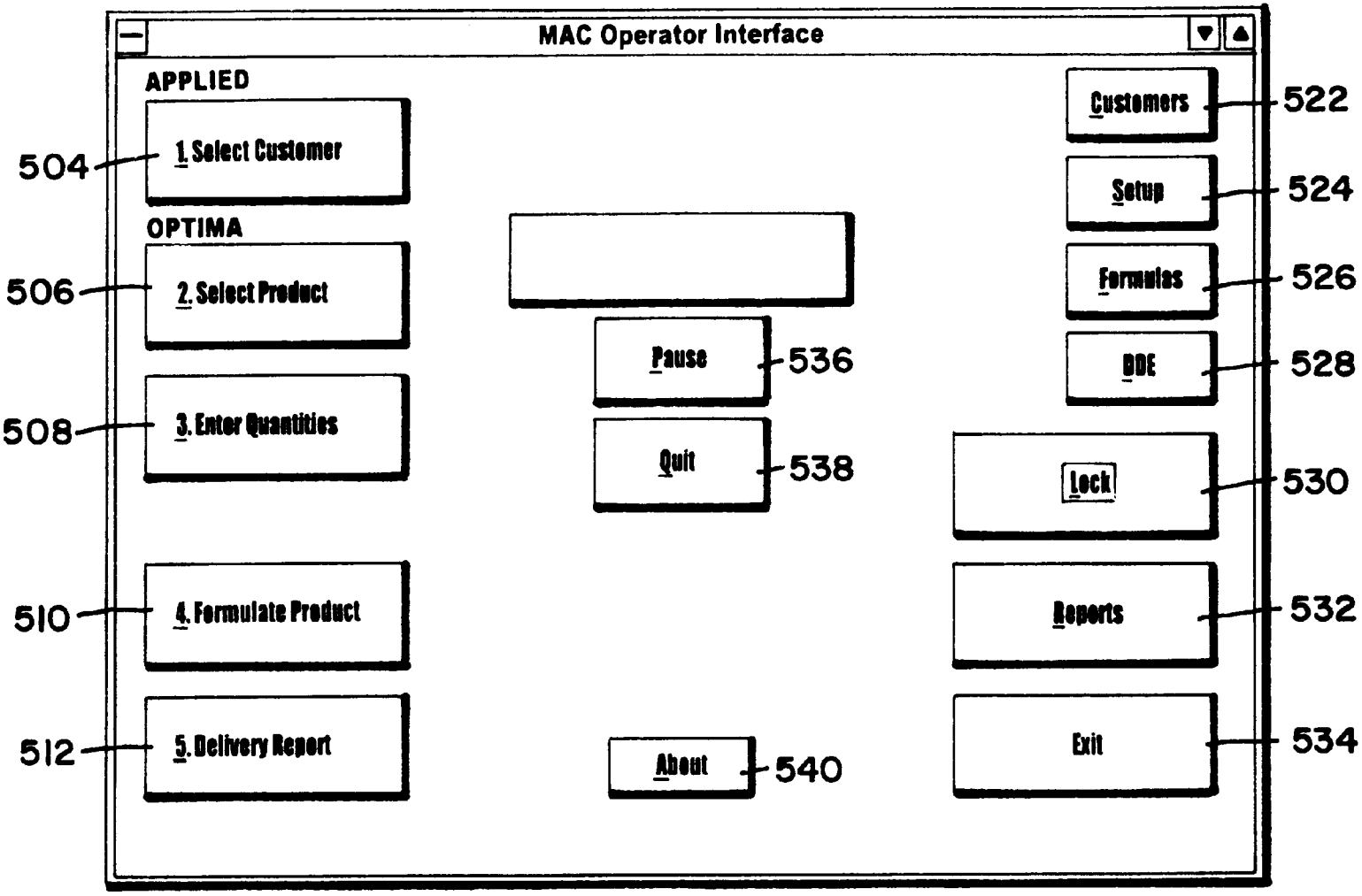
FIG. 5C illustrates the user interface screen generated by the operator interface program 112 after level 2 (high level) passcode has been entered and accepted.

If level 2 access is granted, then the screen shown in FIG. 5C appears on the monitor and the setup person may edit information that describes the type of pumps 16, 18 and 20 that are being used, as well as the operating parameters of the pumps 16, 18 and 20. For example, the setup person could specify the volume of chemical concentrate that the pumps 16, 18 and 20 pump per stroke and, dependent on the viscosity of the concentrate, designate the appropriate pump stroke rate. The higher the viscosity of the concentrate, the more time per stroke that is required to pump the chemical concentrate in and out of the pump cylinder.

A setup person with level 2 access can edit the finished product formulations in addition to being able to perform all the level 1 activities. Those of skill in the art will appreciate that other password and access schemes may be utilized in connection with operation of the MAC. The password access described herein should not be construed as being limited, and is presented as an example of an embodiment.

The setup person with level 1 access may activate the button 522, labeled "Customers" in order to add new, edit or remove customer information and select product formulations from a list of approved formulas. The setup person with level 2 access may activate the button 521, labeled "setup", in order to add, edit or remove chemical pump setup information. This pump setup information includes "On Time" and "Off Time" for the T-Stroke Pumps. The pump setup information also includes volume factors in gallons per stroke or gallons per second. Also included in "Setup" is the pass codes for both low (level 1) and high (level 2) passcodes. The setup person may activate the button 526, labeled "Formulas" (level 2) in order to add new, edit or remove raw materials and their respective properties in units per 100 units. The setup person may activate the button 528, labeled "DDE" (level 2) in order to monitor DDE activity. The setup person may activate the button 530, labeled "Lock" in order to leave SETUP OPERATIONS and return to the screen shown in FIG. 5A. The setup person may activate the button 532, labeled "Reports" in order to create on screen dated reports, create disk transfer data (data transferred from the hard drive to the floppy drive 104) and delete report ranges. The setup person may activate the button 534, labeled "Exit" in order to exit the computer program 110.

The buttons 536 and 538, labeled "Pause" and "Quit" are not active in SETUP OPERATIONS. Activation of the button 540, labeled "About" results in a display on the monitor of information about the computer program 110.

Figure 6:
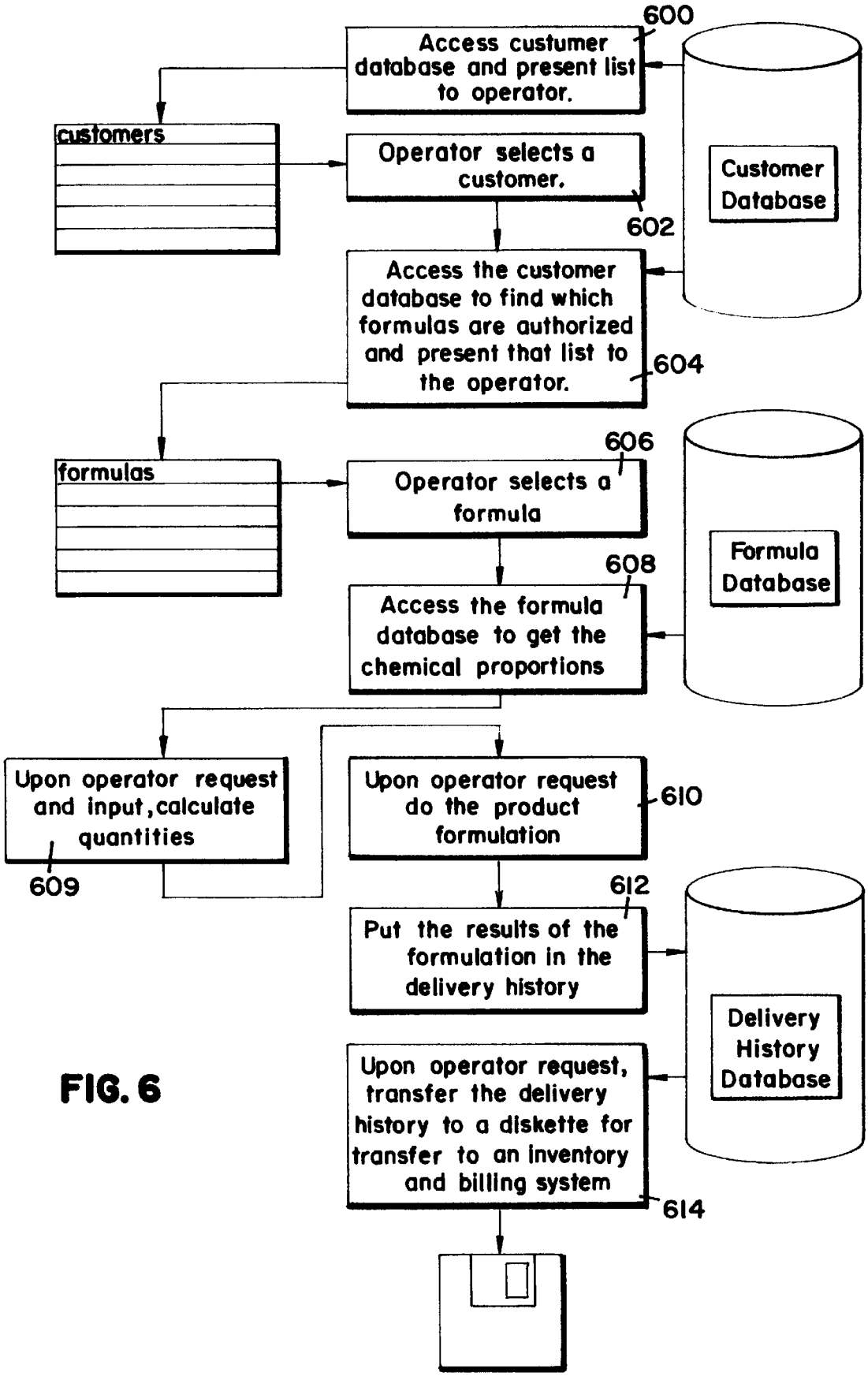
FIG. 6 is a logic flow diagram illustrating the basic data flow by the operation of the operator interface programming block 112.

The second path that can be taken from the opening screen shown in FIG. 5A on the monitor 102 is the FIELD OPERATION path. The FIELD OPERATION path is the path taken at the site of use (e.g., when it is desired to dispense the composition). FIG. 6 illustrates a flowchart showing the steps performed by the operator interface 112 when the operator has chosen the FIELD OPERATION path.

Block 600 represents the operator interface 112 accessing the customer database and presenting a list of customers to the operator on the monitor 102 in response to the operator activating the button 504. Block 602 represents the operator selecting a customer from the list. Block 604 represents the operator interface 112 (in response to the operator activating the button 506) accessing the customer database, retrieving a list of formulations authorized for the chosen customer and presenting that list of formulations to the operator. Block 606 represents the operator selecting a formulation from the list of presented formulations. Block 608 represents the operator interface 112 accessing the formula database to get the chemical concentrate proportions. Block 609 represents the operator interface 112, in response to the operator activating button 508, prompting the operator for information including the current amount of final composition in the storage container 64 and the desired amount of final composition. From the presented information, the operator interface 112 calculates the amount of each chemical concentrate to be dispensed.

Block 610 represents the receiving of a request by the operator (by the activation of button 510), to dispense the designated formulation from the concentrate containers 10, 12 and 14 into the storage container 64. It will be appreciated that soft buttons are also provided on the controller 47 for pausing or aborting the formulation.

Block 612 represents the operator interface 112 placing the results of the formulation, such as what formulation was dispensed and how much was dispensed, into the delivery history database. The information in the delivery history database can be accessed to print out reports and invoices. Block 614 represents the operator requesting a transfer of the delivery history that is contained in the delivery history database to a diskette or other tangible media for transfer to an inventory and billing system. The operator request represented by block 614 is performed by activating the button 512. The operator interface 112 may also prompt the operator to prepare a printed delivery report for the customer.

Figure 7:
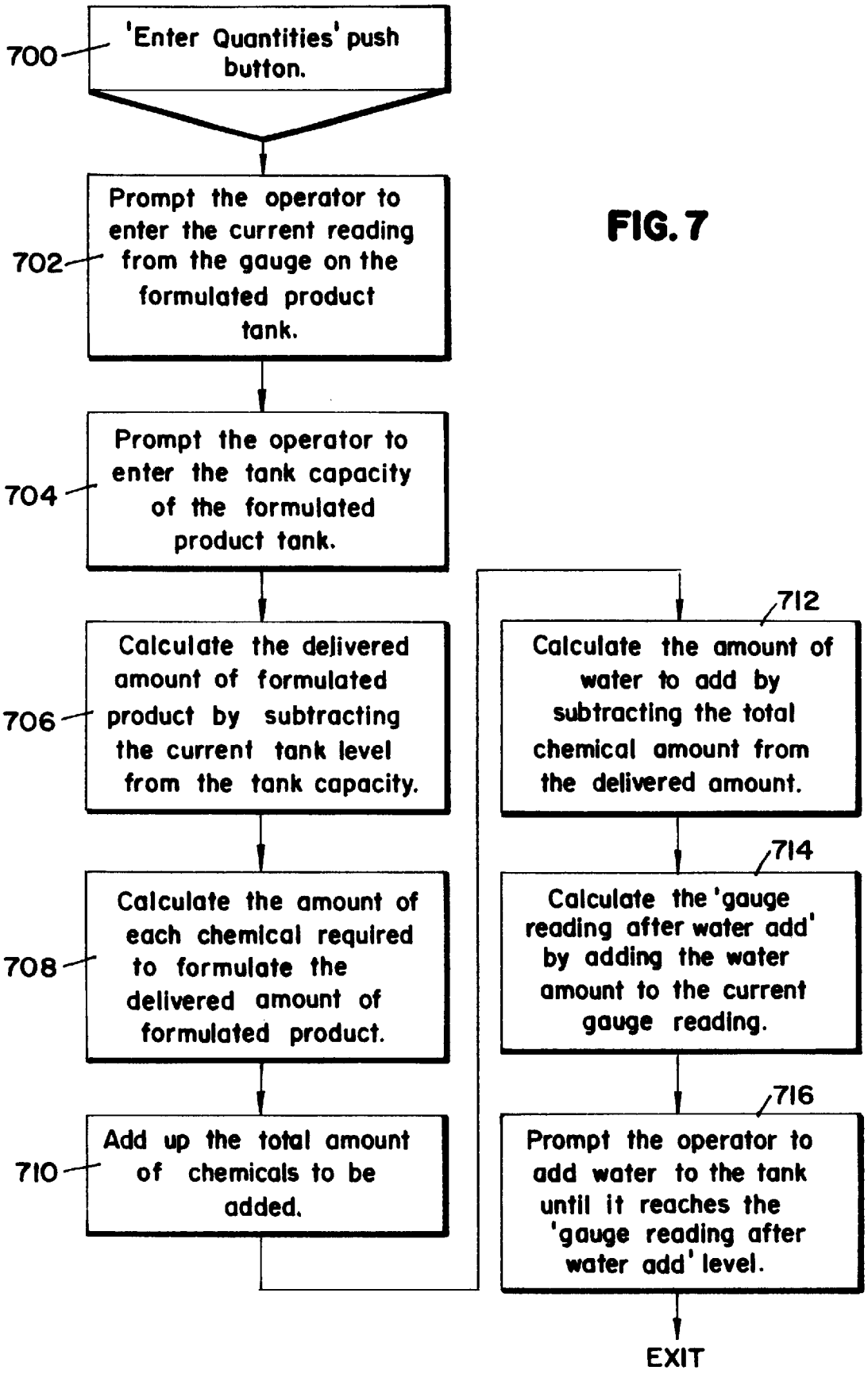
FIG. 7 is a logic flow diagram illustrating the operation of the operator interface programming block 112 when calculating chemical concentrate and carrier (e.g., water) quantities.

FIG. 7 illustrates the operator interface 112 subroutine that performs the functional programming steps represented by the block 609 in FIG. 6. Specifically, these steps illustrated in FIG. 7 comprise the calculating of quantities of the concentrated chemicals and water to be dispensed. Block 700 represents the operator designating a desire to enter quantities by activating the "Enter Quantities" button 508. Block 702 represents the operator interface 112 prompting the operator to enter the current reading from the gauge on the storage container 64. This reading represents the amount of formulation already present in the storage container 64 prior to the current dispensing action. Block 704 represents the operator interface 112 prompting the operator to enter the capacity of the storage container 64. Block 706 represents the operator interface 112 calculating the delivered amount of formulated product by subtracting the starting level of final composition in the storage container 64 (input by the operator in response to the prompt represented by block 702) from the capacity of the storage container 64. The delivered amount is the amount of formulated product (the sum of concentrated chemicals and water) that must be added to the storage container 64 to fill it to capacity. Block 708 represents the operator interface 112 calculating the amount of each chemical concentrate that is required to formulate the delivered amount of formulated product. Block 710 represents the operator interface 112 adding the total amount of chemicals to be added to the storage container 64. Block 712 represents the operator interface 112 subtracting the total chemical amount, (determined by the operator interface 112 in block 710) from the delivered amount (calculated by the program in block 706) thereby calculating the amount of water to be added to the storage container 64. Block 714 represents the operator interface 112 calculating the "gauge reading after water add" which is the point on the gauge on the storage container 64 to which water should be added. The "gauge reading after water add" is calculated by adding the water amount calculated in block 712 to the current gauge reading input by the operator in response to the prompt represented by block 702. Block 716 represents the operator interface 112 prompting the operator to add water to the tank until it reaches the "gauge reading after water add" level.

Figure 8:
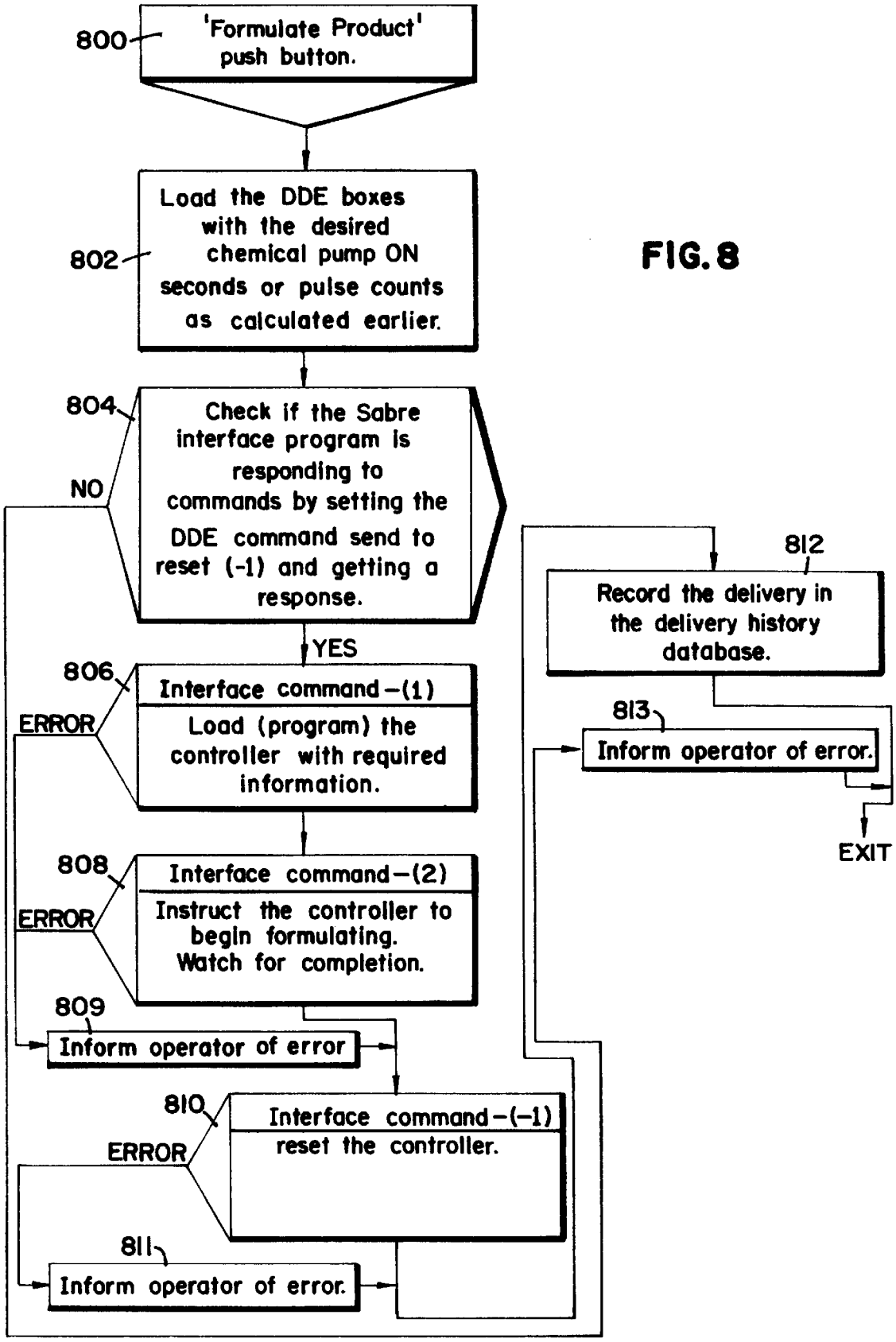
FIG. 8 is a logic flow diagram illustrating the programming steps of the operator interface programming block 112 during product formulation.

FIG. 8 illustrates the functional programming steps included in formulating the product to be dispensed. The functions represented by the block 610 of FIG. 6 are performed by the subroutine represented in FIG. 8. First at block 800, the operator designating a desire to formulate a specific product by activating the "Formulate Product" button 510 is represented. Block 802 represents the operator interface 112 loading the DDE boxes with the desired chemical pump ON seconds or pulse counts as calculated earlier. The pump ON seconds refers to the amount of time that a particular pump must be pumping in order to dispense the desired amount of chemical concentrate connected to that particular pump. The pulse counts refers to the number of strokes that a particular pump must go through in order to pump the desired amount of chemical concentrate connected to that particular pump. The relationship between pulse counts and volume may be determined by the volume of the pump cylinder.

Block 804 represents the operator interface 112 checking if the SABRE™ interface 114 is responding to commands by setting the DDE command send to reset (−1) and getting a response from the SABRE™ interface 114. If there is not a response from the SABRE™ interface 114, then the operator interface 112 informs the operator of an error as represented by block 813. If the SABRE™ interface 114 responds, then, as represented by block 806, the SABRE™ interface 114 loads the controller 46 with a new text file. The text file contains all of the information that is in the DDE boxes such as the amount of water, and amount of each concentrate chemical (expressed as either pulse counts or pump ON time) that must be dispensed. If there is an error in loading the text file into the controller 47, then an error message is displayed on the monitor 102 as represented by block 809. If the text file is loaded into the controller 46 without error, then the operator interface 112 instructs the controller 47 to begin formulating, as represented by block 808. If there is an error in instructing the controller to begin formulating, then the operator interface 112 places an error message on the monitor 102 as represented by block 809. Block 808 also represents the operator interface 112 watching the response values coming returning from the controller 47 to monitor the completion of the dispensing operations.

When the dispensing operations are complete, then the operator interface 112 resets the controller 47 as represented by block 810, thereby eliminating the information in the text file from the controller 46 memory. Because the controller 47 is reprogrammed on every formulation it means that the number of different formulations is limited only by the database capacity of the supporting computer 100. The exact limit is determined by the space on the hard drive 105 but can easily be in the thousands of formulations. Moreover, in the event of a controller 47 malfunction, a new controller with unknown setup programming (including a new controller 47 from the factory) can be put in place and will operate without any extra operator action.

If there is an error in resetting the controller 47, then the operator interface 112 informs the user of the error as represented by block 811. Block 812 represents the operator interface 112 recording the delivery in the delivery history database.

Figure 9A:
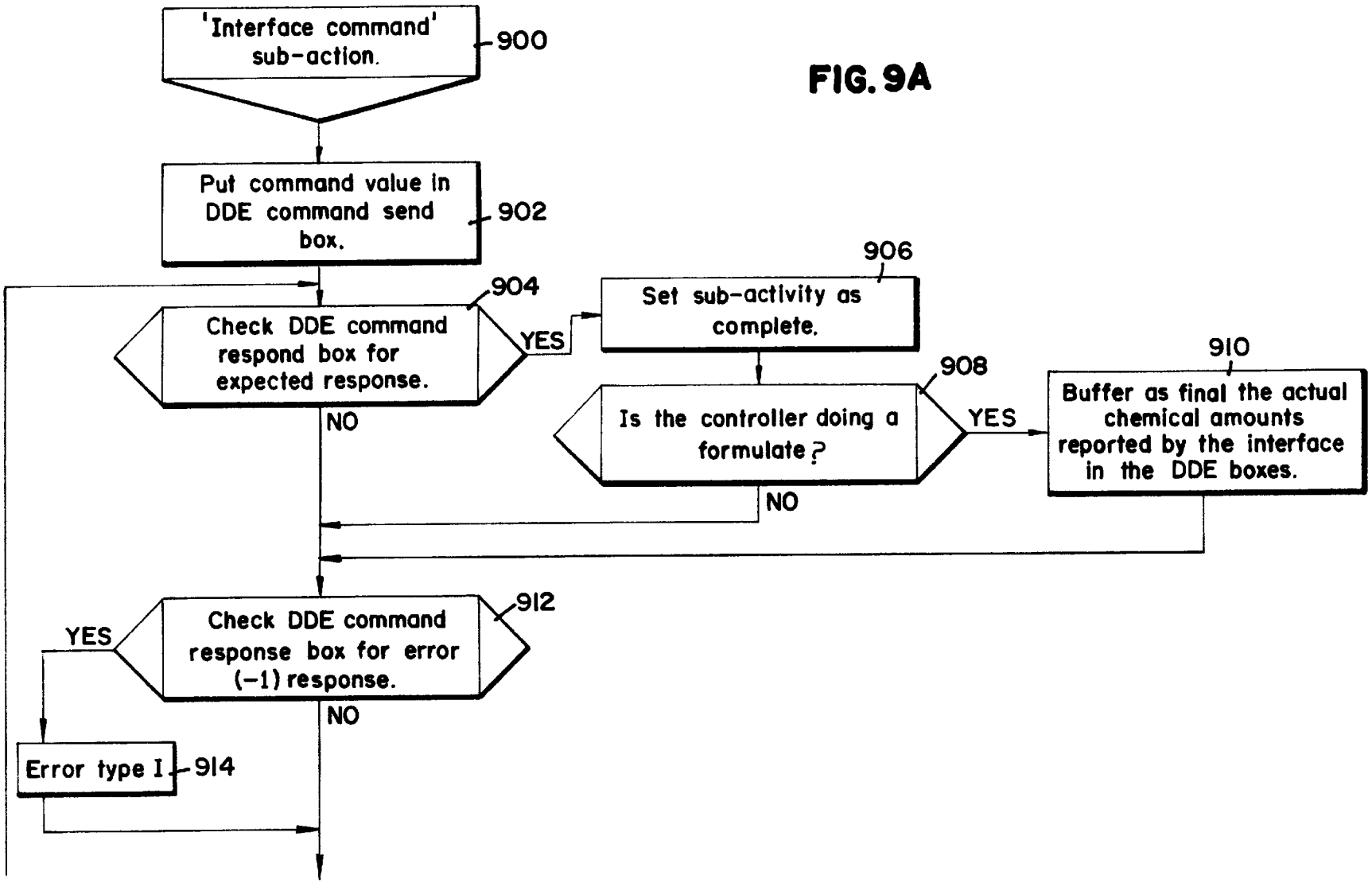
FIG. 9 is a logic flow diagram illustrating the interface between the operator interface programming block 112 and the controller 46 of the invention.
Figure 9B:
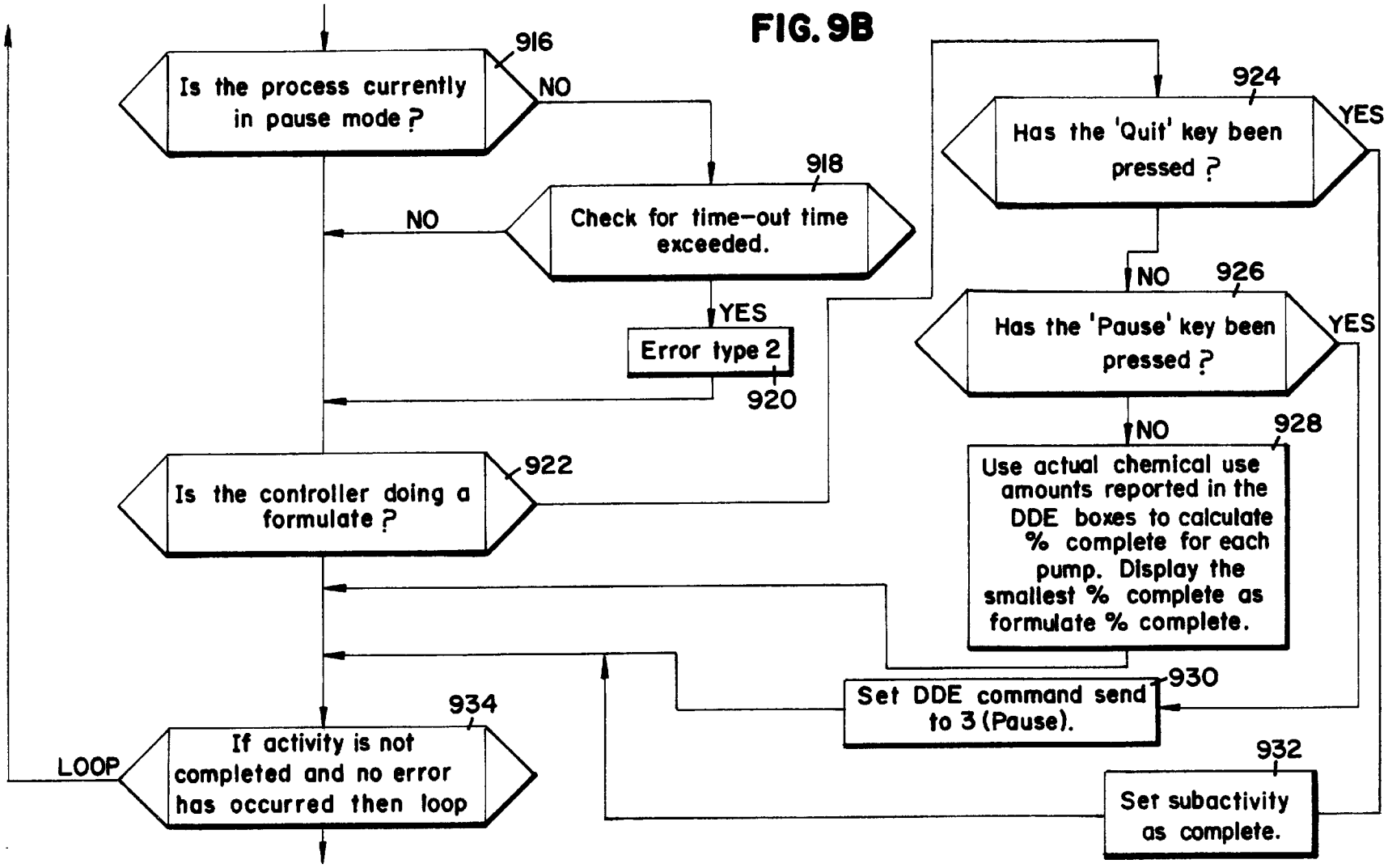

FIG. 9 illustrates the functional programming steps performed in the operations of the operator interface 112 and SABRE™ interface 114. These programming steps make up the subroutine that is generally represented by the blocks 806, 808, 809, 810 and 811 of FIG. 8.

Block 900 represents that this is a sub-action of the "Interface command" designated by blocks 806, 808, 809, 810 and 811 of FIG. 8. The description that follows is a generic description that applies to any DDE command.

Block 902 represents the operator interface 112 placing a command value in the DDE command send box. For example, a "−1" command value in the DDE command send box represents a command from the operator interface 112 to the SABRE™ interface 114 to reset the controller 46. Standard DDE communications protocol is used. Block 904 represents the operator interface 112 checking the DDE command respond box for the expected response. If the expected response is not received, then the next step is shown in block 912 which will be described shortly. If the expected response is received, then the operator interface 112 sets the sub-activity as complete, as represented by block 906, and then goes on to block 908. Block 908 represents the operator interface 112 determining, based on the contents of the DDE boxes, whether the controller 47 is operationally preparing a formulate. If the controller 47 is operationally preparing a formulate, then the operator interface 112 buffers the final and actual chemical amounts reported by the interface in the DDE boxes, as represented by block 910. If the controller 47 is not operationally preparing a formulate at block 908 (or if block 910 is completed), then the next step is represented by block 912.

Block 912 represents the operator interface 112 checking the DDE command response box for an error (−1) response. If there is an error response, then the operator interface 112 continues through to block 934. If the activity is not complete and no error has occurred, then operations loop back to the actions represented by block 904. If an error is present, then operations return to the calling function (represented by blocks 806, 808 or 810) as represented by block 914. The operator interface 112 checks to see if the process is currently in pause mode, as represented by block 916. If the process is not in pause mode, then block 918 represents the operator interface 112 checking to determine whether the "time out" time period is exceeded. If the "time out" period is exceeded then the operator interface 112 continues through to block 934. If the activity is not complete and no error has occurred, then operations loop back to the actions represented by block 904. If an error is present, then operations return to the calling function (represented by blocks 806, 808 or 810), as represented by block 920. Next, the operator interface 112 checks to determine whether the controller 46 is preparing a formulate, as represented by block 922. If the controller 46 is not preparing a formulate, then the operator interface 112 determines whether the "Quit" button on the monitor 102 has been activated, as represented by block 924. If the "Quit" button has been pressed, then block 932 represents interface command reporting back to formulate product (formulate product represented by FIG. 8), that a quit (Abort) has been requested. If a "Quit" button has not been activated then block 926 represents the operator interface 112 determining whether the "Pause" button has been pressed. If the "Pause" button has been activated, then the operator interface 112 sets the DDE command send box to "3" (Pause), as represented by block 930.

If the "Pause" button has not been activated, then block 928 represents the operator interface 112 using actual chemical use amounts reported in the DDE boxes to calculate the percentage of concentrated chemical that has been pumped for each pump, as compared to the total amount of that particular concentrated chemical to be dispensed. Block 928 also represents the operator interface 112 displaying the smallest percentage complete, whichever pump that might be, as the formulate percentage complete. Block 934 represents the operator interface 112 determining if the activity requested in block 902 is completed and whether an error has occurred. If the activity is not completed and no errors occurred, then operation returns to block 904. If the activity is completed or if there is an error, then operation exits back to the calling function, i.e., as represented by one of blocks 806, 808 or 810 in FIG. 8.

d. Applications

One exemplary application for the dispensing system of the invention is in the treatment of bovine mastitis. Compositions of this invention include typical mastitis control and prevention treatments often described as "teat dips," though of course other methods of topical aseptic application might be used, for example spraying or swabbing or foaming onto the teats. When employed as a teat dip, which is a particularly effective practice of application, the teats of the animal are dipped in a reservoir or receptacle containing a composition of the present invention. Preferably one-half to three-fourths of the distal end of teat has been coated with treatment.

Compositions of the invention preferably have sufficiently low viscosity to allow easy application to the teat. However, these compositions preferably are not so thin as to drip completely off the end of the teat. These teat dips must coat smoothly and form a continuous efficacious layer over the skin of the teat. It is desirable for the compositions to flow slightly down the teat following application to form a thicker layer or "plug" across the orifice of the teat canal. By doing so the composition provides a more effective prophylaxis barrier against bacteria entering the teat canal.

Teat dipping using a well balanced formulation accomplishes three essential functions. Dipping displaces the final drops of milk adhering on the end of the teat which if left unattended, become an excellent media for infectious organisms. Dipping kills most organisms present on the surface of teat skin and inhibits the transport of pathogenic organisms into the teat canal. Dipping also protects the skin of the teat from irritation caused by exposure to adverse environmental factors, aids in healing minor skin damage and teat lesions, and contributes to the overall health of the teat and udder.

Teat dips dispensed in accordance with invention may generally comprise a carrier, an antimicrobial agent or admixture, a rheology modifier or admixture, an emollient or admixture, a buffer system, a surfactant or surfactant mixture, a chromophore or colorant, and other adjuvants or adjuncts.

The preferred compositions of this invention comprise ingredients which are generally regarded as safe, food additive or otherwise of food grade purity and are not of themself or in admixture incompatible with milk or milk by-products. Likewise, ingredients must be selected for any given composition which are cooperative in their combined effects whether incorporated for antimicrobial efficacy, physical integrity of the formulation or to facilitate healing and the health of the teat.

1. CARRIER

Generally, the composition comprises a carrier which functions to dilute the active ingredients and facilitates application to the intended surface. The carrier is generally an aqueous or organic liquid such as water, an oil, a surfactant, an alcohol, an ester, an ether, or an organic or aqueous mixture of any of these. Water is preferred as a carrier or diluent in compositions of this invention because of its universal availability and unquestionable economic advantages over other liquid diluents.

One of ordinary skill in this art will be aware of the fact that the pH of water can vary with solubilized constituents such as hardness; however, water treatment or a well-designed buffer system can compensate for these variations of water sourcing and therefore neutralize any potential physical, chemical or antimicrobial interferences to the end use composition.

2. ANTIMICROBIAL AGENT

Numerous inorganic and organic antimicrobial agents may be utilized in teat dip compositions including (but not limited to) chlorine and bromine release compounds (e.g. alkali and alkaline earth hypochlorites and hypobromites, isocyanurates, chlorinated derivatives of hydantoin, sulfamide, amine, etc.), iodine release complexes of surfactants or polymers such as polyvinylpyrrolidone (termed iodophors), quartenary ammonium compounds, chlorhexidine salts, peroxide and peroxy acid compounds, protonated short chain carboxylic acids (e.g. R=$C_7$–$C_1$l, R—COOH), acidified anionic surfactants and chlorine dioxide.

Of these topically applied antimicrobial agents which have been investigated for control of bovine mastitis, iodophors, acidified anionic surfactants, and chlorhexidine salts presently appear to have gained wide acceptance among dairy herd managers, are generally regarded as safe to use, proven efficacious against mastitis causing microorganisms; and, are preferred in compositions of the present invention.

3. RHEOLOGY MODIFIER

The composition of the invention may also contain one or more rheology modifiers, to enhance viscosity, or thicken and cause the aqueous treatment to cling to the surface skin of the teat. Clinging enables the composition to remain in contact with transient and resident pathogenic bacteria for longer periods of time, promoting microbiological efficacy and resisting waste because of excessive dripping. The rheology modifier may be a film former or act cooperatively with a film forming agent to form a barrier that provides additional protection.

Water soluble or water dispersible rheology modifiers that are useful can be classified as inorganic or organic. The organic thickeners can further be divided into natural and synthetic polymers with the latter still further sub-divided into synthetic natural-based and synthetic petroleum-based.

Inorganic thickeners are generally compounds such as colloidal magnesium aluminum silicate (Veegum™), colloidal clays (bentonites), or silicas (Cab-O-Sils™) which have been fumed or precipitated to create particles with large surface to size ratios.

Natural hydrogel thickeners of use are primarily vegetable derived exudates. For example, tragacanth, karaya, and acacia gums; and extractives such as caragheenan, locust bean gum, guar gum and pectin; or, pure culture fermentation products such as xanthan gum are all useful in the invention. Chemically, all of these materials are salts of complex acidic polysaccharides. Synthetic natural-based thickeners having application are cellulosic derivatives wherein the free hydroxl groups on the linear anhydroglucose polymers have been etherified or esterified to give a family of substances which dissolve in water and give viscous solutions. This group of materials includes the alkyl and hydroxylalkylcelluloses, specifically methylcellulose, hydroxyethylmethylcellulose, hydroxypropylmethylcellulose, hydroxybutylmethylcellulose, hydroxyethylcellulose, ethylhydroxyethylcellulose, hydroxypropylcellulose, and carboxymethylcellulose. Synthetic petroleum-based water soluble polymers are prepared by direct polymerization of suitable monomers which polyvinylpyrrolidone, polyvinylmethylether, polyacrylic acid and polymethacrylic acid, polyacrylamide, polyethylene oxide, and polyethyleneimine are representative.

Preferred aqueous thickening agents which are more useful in this invention are those which are extremely pseudoplastic (non-Newtonian, rapid relaxation), tend not to develop a rigid three-dimensional structure from interpolymer interactions, have a low or negligible viscoelastic character and possess a high gel strength. Such rheological properties are manifested in a teat dip composition which has a smooth flowing appearance, is easy to pour and apply onto the teat, coats uniformly without forming muscilage streamers as the applicator is withdrawn and remains firmly in place without significant sag. Examples or preferred rheology modifiers are xanthan gum and the hydroxylalkylcelluloses.

Frequently, no rheology modifier is added to compositions of this invention as a separate ingredient because sufficient viscosity is imparted to the admixture by other constituents. For example, with mastitis control treatments employing iodine as the antimicrobial, sufficient viscosity may be imparted to the composition by the surfactant of the iodophor complex. This is a well known phenomena of colloidal and surface chemistry caused by micelle structures which are organized three dimensional aggregates of surfactant formed within the aqueous carrier. Another example is compositions containing high levels of emollients such as glycerin or sorbitol. These polyols desiccate the composition by associating through hydrogen bonding to water molecules of the carrier which has the effect of increasing viscosity.

Generally, the concentration of thickener used in the present invention will be dictated by the final composition and by the method of teat application. Spraying or misting requires a lower composition viscosity for easy and effective application of treatment than dipping. Film forming barrier dips typically require high apparent viscosity necessary to form thick coatings on teats which insures improved prophylactic effect.

4. EMOLLIENT

Teat dip compositions of the present invention generally also comprise an emollient and/or humectant to lubricate, condition and generally reduce and promote the healing of irritation on the teat surface of application which may result either from the antimicrobial agent, from the mechanical action of the milking machine or from environmental conditions such as wind chill, dehydration, abrasion and sunburn. Any water soluble or dispersible skin conditioning agent may be used in this present invention. Compositions such as polyhydric alcohols are useful in the invention including glycerin, sorbitol, mannitol, and propylene glycol and its homopolymers; fatty acid esters of simple monohydril alcohols including isopropyl palmitate or isopropyl myristate and similar esters; polyol esters of fatty acids; and, ethoxylated lanolins, vegetable oils, and similar natural sourced derivatives such as Aloe. Preferred emollients to be used in the invention include glycerine, sorbitol, and propylene glycol.

5. BUFFER SYSTEM

The classical definition of a buffered solution is one containing both a weak acid and its conjugate weak base, whose pH changes only slightly on addition of acid or alkali. The weak acid becomes a buffer when alkali is added, and the weak base becomes a buffer when acid is added. Maintenance of the pH of compositions described in the present invention is necessary to minimize undesirable chemical changes which may inhibit the microbiological efficacy of the antimicrobial agent or cause toxic or irritating effect upon the teat. Any compatible organic or inorganic material or mixture of materials which has the desired effect of maintaining the composition pH within prescribed ranges can by utilized as the buffering agent or system in the instant invention. Of primary concern are pH shifts caused by naturally occurring chemicals brought into the composition by the water used as diluent and carrier; and, pH drifting which sometimes accompanies chemical equilibriums established within compositions as ingredients are changed or concentrations varied.

In practice, the pH of bovine mastitis control treatments can vary from a low of about pH 2.0 to a maximum of approximately 11.0 depending primarily upon the choice of antimicrobial agent being incorporated into the composition because optimal efficacy normally occurs within a specific, narrow, pH range. Therefore the buffering agent or system is chosen accordingly. If an iodophor is the antimicrobial agent, the pH range is typically from about 2.5 to 5.0—the lower value being a limit to prevent excessive irritation on the teat surface. A typical and preferred buffer system would be citric acid and its alkali metal salt. However, any organic food acidulant and corresponding conjugate weak base could be used.

6. SURFACTANT

The surfactant or surfactant admixture of the present invention can be selected from compatible water soluble or water dispersible nonionic, or anionic surface-active agents; or mixtures of each or both types.

Nonionic and anionic surfactants offer diverse and comprehensive commercial selection, low price; and, most important, excellent detersive effect—meaning surface wetting. Surface—active or "wetting agents" function to increase the penetrant activity of the invention into the tissue surface at risk from mastitis causing pathogens.

Nonionic surfactants useful in the invention are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants in the present invention include:

1. Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade name Pluronic® manufactured by BASF Corp.

Pluronic® compounds are difunctional (two reactive hydrogens) compounds formed by condensing ethylene oxide with a hydrophobic based formed by the addition of propylene oxide to two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10 by weight to about 80% by weight of the final molecule.

Tetronic® compounds are tetra-functional block copolymers derived from the sequential additional of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

2. Condensation products of one mole of alkyl phenol wherein the alkyl constituent, contains from about 8 to about 18 carbon atoms with from about 3 to about 50 moles of ethylene oxide. The alkyl group can, for example, be represented by diisobutylene, di-amyl, polymerized propylene, isoctyl, nonyl, and di-nonyl. Examples of commercial compounds of this chemistry are available on the market under the trade name Igepal® manufactured by Rhone-Poulenc and Triton® manufactured by Union Carbide.

3. Condensation products of one mole of a saturated or unsaturated, straight or branched chain alcohol having form about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade name Noedol® manufactured by Shell Chemical Co. and Alfonic® manufactured by Vista Chemical Co.

4. Condensation products of one mole of saturated or unsaturated, straight or branched chain carboxylic acid having from about 8 to about 18 carbon atoms with from about 6 to about 50 moles of ethylene oxide. The acid moiety can consist of mixtures of acids in the above delineated carbon atoms range or it can consist of an acid having a specific number of carbon atoms within the range. Examples of commercial compounds of this chemistry are available on the market under the trade name Nopalcol® manufactured by Henkel Corporation and Lipopeg® manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention. All of these ester moieties have one or more reactive hydrogen sites on their molecule which can undergo further acylation or ethylene oxide (alkoxide) addition to control the hydrophilicity of these substances.

5. Compounds from (1) which are modified, essentially reversed, by adding ethylene oxide to ethylene glycol to provide a hydrophile of designated molecular weight; and, then adding propylene oxide to obtain hydrophobic blocks on the outside(ends) of the molecule. The hydrophobic portion of the molecule weighs from about 1,000 to about 3,100 with the central hydrophile comprising 10% by weight to about 80% by weight of the final molecule. These reverse Pluronics® are manufactured by BASF Corporation under the trade name Pluronic® surfactants.

Likewise, the Tetronic® surfactants are produced by BASF Corporation by the sequential addition of ethylene oxide and propylene oxide to ethylenediamine. The hydrophobic portion of the molecule weighs from about 2,100 to about 6,700 with the central hydrophile comprising 10% by weight to 80% by weight of the final molecule.

6. Tertiary amine oxides corresponding to the general formula:

$$R^1(OR^4)_n\ N(R^2)(R^3)\rightarrow 0$$

Wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are selected from the group consisting of alkyl or hydroxyalkyl of 1–3 carbon atoms and mixtures thereof; $R^4$ is an alkaline or a hydroxylakylene group containing 2 to 3 carbon atoms; and n ranges form 0 to about 20.

Useful water soluble amine oxide surfactants are selected from the coconut or tallow alkyl di-(lower alkyl) amine oxides.

The most preferred nonionic surfactants for use in compositions practiced in the present invention include compounds form groups (1), (2) and (3).

Also useful in the present invention are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counterions) associated with these polar groups, sodium, lithium and potassium impart water solubility.

Examples of suitable synthetic, water soluble anionic compounds are the alkali metal (such as sodium, lithium and potassium) salts of the alkyl mononuclear aromatic sulfonates such as the alkyl benzene sulfonates containing from about 5 to about 18 carbon atoms in the alkyl group in a straight or branched chain, e.g., the salts of alkyl benzene sulfonates or of alkyl toluene, xylene, cumen and phenol sulfonates; alkyl naphthalene sulfonate and alkoxylated derivatives. Other anionic detergents are the olefin sulfonates, including long chain alkene sulfonates, long chain hydroxyalkane sulfonates or mixtures of alkene-sulfonates and hydroxyalkanae-sulfonates. Also included are the alkyl sulfates, alkyl poly (ethyleneoxy) ether sulfates and aromatic poly (ethyleneoxy) sulfates such as the sulfates or condensation products of ethylene oxide and nonyl phenol (usually having 1 to 6 oxyethylene groups per molecule).

7. CHROMAPHORE OR COLORANT

Complexed iodines offer the advantage of being chromophoric, i.e. easily visible when applied onto the teat. Other antimicrobial agents do not have this feature; therefore, compositions of this invention may include a water soluble or dispersible coloring agent (dyes or pigments) or mixtures of agents which render the compositions chromophoric, having sharp contrast to teat skin, permitting the diary herd manager to visually discern that teats have been treated.

8. OTHER ADJUVANTS

Alternatively, the compositions of the invention may comprise any number of optional ingredients, i.e. adjuvants. Depending upon the benefits provided, adjuvants may partially or wholly displace the carrier in the composition. Generally, in accordance with the invention, there may be included within this composition formulary adjuvants which assist in the application of the invention with respect to physical and chemical stability, barrier film formation, teat health maintenance, performance, physical form, manufacturing process and aesthetics. Of course these functions may be accomplished exclusively by composition ingredients already described or admixtures thereof; however, formulary or application or performance situations may occur requiring additional effect which may be accomplished by introducing an additional inorganic or organic agent or agents and mixtures thereof into the composition.

Formulary adjuvants include coupling agents, solubilizers, or hydrotropes used to maintain physical integrity and storage stability or the present composition. To this end, any number of monofunctional and polyfunctional alcohols may be employed. For compositions designed to provide a barrier film or prophylactic protection, additional film forming adjuvants are included which typically work in cooperation with thickeners, for example polyvinyl alcohol and latex polymers such as ethyl acrylate/methyl methacrylate copolymer.

The compositions of the invention may optionally include medicaments, for example sunscreens such as paraamino benzoic acid and healing agents such as allantoin to provide curative action and stimulation of formation of new tissue; preservatives such as methyl paraben, propyl paraben, sorbic and benzoic acids or salts thereof to retard bacterial growth and prolong shelf life; antioxidants such as BHT (butylated hydroxytoluene), BHA (butylated hydroxyanisole), TBHQ (tert-butylhydroquinone), or propyl gallate to retard oxidative or hydrolytic degradation; sequestering agents such as aminopolyacetates, polyphosphonates, aminpolyphosphonates, polycarboxylates, and condensed phosphates; and, manufacturing processing agents, for example defoam additives employed to facilitate blending and mixing.

A wide variety of ingredients useful in mastitic control treatment can be included in the compositions hereof. This list is not intended to be exhaustive and other optional ingredients, which may not be listed but which are well known in the art, may also be utilized in the composition. The examples are not intended to be limited in any way. In certain cases, some of the individual adjuvants may overlap other categories. The adjuvants employed will be selected so as not to interfere with the antimicrobial action of the composition and to avoid physical or chemical instability of the product.

Table 2, below, provides guidelines for constituent concentrations in accordance with the invention.

TABLE 2

TEAT DIP ADMIXTURE COMPOSITIONS (wt - %)

| | USEFUL | PREFERRED | MORE PREFERRED |
|---|---|---|---|
| ANTIMICROBIAL | 0.1–12.0 | 0.15–11.0 | 0.2–10.0 |
| RHEOLOGY MODIFIER | 0.0–15.0 | 0.0–12.0 | 0.0–9.0 |
| EMOLLIENT | 0.5–60.0 | 1.0–40.0 | 1.5–20.0 |
| BUFFER | 0.0–15.0 | 0.1–10.0 | 0.2–5.0 |
| SURFACTANT | 0.0–60.0 | 0.25–40.0 | 0.5–20.0 |
| COLORANT | 0.0–1.0 | 0.001–0.8 | 0.002–0.6 |
| CARRIER | 40.0–98.0 | 50.0–98.0 | 60.0–98.0 |

In use, the constituents of the teat dip may be transported to the site of use in separate containers. For example, one container may comprise an antimicrobial and another container may contain an emollient. These two systems may be mixed at the point of use, with a carrier in a storage container. By mixing concentrates at the point of use, incompatibilities are avoided between, for example, buffer systems and emollients.

While not explicitly shown, it will be appreciated that the various components such as computer 100, pumps 16, 18, and 20, etc. are connected to appropriate power supplies and such other peripheral components to operate in their attended manner.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

We claim:

1. A method of dispensing a desired composition at a point of use, the method comprising the steps of:

(a) transporting a plurality of concentrated chemical compositions to the point of use using a vehicle having a plurality of concentrate containers disposed thereon, each concentrate container storing one of the plurality of concentrated chemical compositions;

(b) generating a formulation of a desired teat dip composition, the formulation specifying predetermined quantities of at least one of the concentrated chemical compositions; and (c) delivering the predetermined quantities of at least one of the concentrated chemical compositions to a storage container at the point of use.

2. The method of claim 1, wherein the formulation specifies that at least two of the concentrated chemical compositions are mixed.

3. The method of claim 2, wherein the predetermined quantities of concentrated chemical compositions are delivered concurrently to the storage container.

4. The method of claim 2, wherein the predetermined quantities of concentrated chemical compositions are delivered sequentially to the storage container.

5. The method of claim 2, wherein at least two of the concentrated chemical compositions are incompatible when in concentrated form.

6. The method of claim 2, wherein each of the plurality of concentrated chemical compositions is selected from the group consisting of an antimicrobial agent, a rheology modifier, an emollient, a humectant, a buffer, a wetting agent, a colorant, a stabilizer, and combinations thereof.

7. The method of claim 2, wherein the plurality of concentrated chemical compositions includes iodine, glycerine and sorbitol.

8. The method of claim 1, wherein the generating step includes the step of selecting the desired formulation of final teat dip composition from a plurality of predetermined formulations.

9. The method of claim 1, wherein the generating step includes the step of generating a custom formulation of final teat dip composition.

10. The method of claim 1, further comprising the step of determining an amount of final teat dip composition required at the point of use, and wherein the generating step includes the step of calculating the predetermined quantities of concentrated chemical compositions required to form the determined amount of the desired formulation of final teat dip composition.

11. The method of claim 10, further comprising the step of calculating the cost of the final teat dip composition delivered to the point of use based upon the quantity of each concentrated chemical composition delivered to the storage container.

12. The method of claim 11, further comprising the step of generating an invoice with the calculated cost.

13. The method of claim 12, further comprising the step of maintaining a customer database with preferred formulations of final teat dip compositions for customer records in the customer database.

14. The method of claim 1, wherein the final composition is a teat dip for application to dairy animals.

15. The method of claim 1, wherein the delivering step is controlled via a controller coupled to a delivery mechanism, and wherein the generating step includes the step of downloading the desired formulation of final teat dip composition to the controller.

16. The method of claim 1 wherein the generating step comprises:

receiving input designating a particular formulation; and accessing a formula database to retrieve the predetermined quantities of the concentrated chemical compositions associated with the formulation.

17. The method of claim 1, wherein the flow rate of concentrated compositions into the storage container at the point of use is between about 0 and 100 ounces per second.

18. The method of claim 1, wherein the storage container holds a maximal volume of between about 0 and 3000 gallons and further comprising the step of mixing the contents of the storage container.

19. The method of claim 1, wherein the storage container comprises polyethylene.

20. The method of claim 1, wherein the final teat dip composition is a bovine teat dip composition.

21. A vehicle-mounted dispensing apparatus, of the type used for dispensing a desired teat dip composition at a point of use, comprising:

(a) a plurality of concentrate containers mounted on a vehicle, each concentrate container storing one of a plurality of concentrated chemical compositions;

(b) means for generating a formulation of a desired teat dip composition, the formulation specifying predetermined quantities of at least one of the concentrated chemical compositions; and (c) means for delivering the predetermined quantities of at least one of the concentrated chemical compositions to a storage container at the point of use.

22. The apparatus of claim 21, wherein the formulation specifies that at least two of the concentrated chemical compositions are mixed.

23. The apparatus of claim 21, wherein the desired formulation further includes means for adding a predetermined quantity of diluent to the desired formulation.

24. The apparatus of claim 21, wherein at least two of the concentrated chemical compositions are incompatible when in concentrated form.

25. The apparatus of claim 21, wherein the final teat dip composition is for application to dairy animals.

26. The method of claim 25 further comprising generating a report containing information about the formulation and the amount of the formulation dispensed.

27. The method of claim 25, wherein the final composition is a teat dip composition.

28. A vehicle-mounted dispensing apparatus for dispensing a final teat dip composition at a point of use, the apparatus comprising:

(a) a plurality of concentrate containers mounted on a delivery vehicle, each concentrate container housing a concentrated chemical composition for use in the formulation of a final teat dip composition;

(b) at least one delivery mechanism coupled in fluid communication with the plurality of concentrate containers to selectively deliver a metered quantity of each concentrated chemical composition to a storage container at the point of use; and (c) a controller configured to activate the delivery mechanism to deliver a desired formulation of final teat dip composition having predetermined quantities of at least two of the concentrated chemical compositions.

29. The apparatus of claim 28, wherein the delivery mechanism includes a plurality of fixed-stroke pumps, each of which is coupled to one of the plurality of concentrate containers; whereby the controller activates a pump for a predetermined period of time to deliver a predetermined quantity of concentrated chemical composition.

30. The apparatus of claim 29, wherein each pump is pneumatically driven, and wherein the controller includes a plurality of solenoids coupled between the plurality of pumps and a pressure source.

31. The apparatus of claim 30, wherein each pump is capable of pumping between about 0 and 100 ounces per second.

32. The apparatus of claim 30, wherein each pump has a cylinder volume of between about 0 and 1 cubic feet.

33. The apparatus of claim 29, wherein the delivery mechanism further comprises a plurality of fill spouts, each of which is coupled to one of the plurality of pumps.

34. The apparatus of claim 28, wherein the concentrate containers have a maximum volume of between about 0 and 3000 gallons.

35. The apparatus of claim 28, further comprising a computer configured to download the desired formulation of final teat dip composition to the controller.

36. The apparatus of claim 35, wherein the computer includes a plurality of predetermined formulations; whereby the desired formulation is selected from the plurality of predetermined formulations.

37. The apparatus of claim 35, wherein the computer is configured to generate a custom formulation of final teat dip composition.

38. The apparatus of claim 35, wherein the computer is configured to receive as input an amount of final teat dip composition to be delivered, and to calculate therefrom the predetermined quantities of concentrated chemical compositions.

39. The apparatus of claim 35, wherein the computer is further configured to calculate a quantity of diluent to add to the storage container to form the desired formulation of final teat dip composition.

40. The apparatus of claim 35, wherein the computer is a portable personal computer.

41. The apparatus of claim 35, wherein the computer includes an invoice generation program configured to calculate the cost of the final teat dip composition delivered to the point of use based upon the quantity of each concentrated chemical composition delivered to the storage container, and to generate therefrom an invoice.

42. The apparatus of claim 41, wherein each concentrated chemical composition is selected from the group consisting of an antimicrobial agent, a rheology modifier, an emollient, a humectant, a buffer, a wetting agent, a colorant, a stabilizer, and combinations thereof.

43. The method of claim 42 wherein the report is an invoice.

44. The apparatus of claim 41, wherein the plurality of concentrate containers includes first, second and third concentrate containers respectively housing iodine, glycerine and sorbitol.

45. The apparatus of claim 35, wherein the computer further includes a customer database coupled to the invoice generation program and configured to store preferred formulations of final teat dip compositions for customers.

46. The apparatus of claim 21, wherein the final teat dip composition is a bovine teat dip composition.

47. The apparatus of claim 28, wherein the final teat dip composition is a bovine teat dip composition.

48. A method of dispensing a desired composition at a point of use, the method comprising the steps of:

(a) transporting a plurality of concentrated chemical compositions to the point of use using a vehicle having a plurality of concentrate containers disposed thereon, each concentrate container storing one of the plurality of concentrated chemical compositions;

(b) generating a formulation of a desired composition, the formulation specifying predetermined quantities of at least two of the concentrated chemical compositions wherein the at least two concentrated chemical compositions are incompatible when in concentrated form; and (c) delivering the predetermined quantities of the at least two concentrated chemical compositions to a storage container at the point of use.

49. A vehicle-mounted dispensing apparatus for dispensing a final composition at a point of use, the apparatus comprising:

(a) a plurality of concentrate containers mounted on a delivery vehicle, each concentrate container housing a concentrated chemical composition for use in the formulation of a final composition;

(b) at least one delivery mechanism coupled in fluid communication with the plurality of concentrate containers to selectively deliver a metered quantity of each concentrated chemical composition to a storage container at the point of use;

(c) a controller configured to activate the delivery mechanism to deliver a desired formulation of final composition having predetermined quantities of at least two of the concentrated chemical compositions; and (d) a portable personal computer configured to download the desired formulation of final composition to the controller.

50. A vehicle-mounted dispensing apparatus for dispensing a final composition at a point of use, the apparatus comprising:

(a) a plurality of concentrate containers mounted on a delivery vehicle, each concentrate container housing a concentrated chemical composition for use in the formulation of a final composition;

(b) at least one delivery mechanism coupled in fluid communication with the plurality of concentrate containers to selectively deliver a metered quantity of each concentrated chemical composition to a storage container at the point of use;

(c) a controller configured to activate the delivery mechanism to deliver a desired formulation of final composition having predetermined quantities of at least two of the concentrated chemical compositions; and (d) a computer configured to download the desired formulation of final composition to the controller, wherein the computer further includes a customer database coupled to an invoice generation program, the customer database configured to store referred formulations of final compositions for customers.

51. A vehicle-mounted dispensing apparatus, of the type used for dispensing a desired compose ion at a point of use, comprising:

(a) a plurality of concentrate containers mounted on a vehicle, each concentrate container storing one of a plurality of concentrated chemical compositions, wherein at least two of the concentrated chemical compositions are incompatible when in concentrated form;

(b) means for generating a formulation of a desired composition, the formulation specifying predetermined quantities of at least two of the concentrated chemical compositions; and (c) means for delivering the predetermined quantities of at least two of the concentrated chemical compositions to a storage container at the point of use.

52. The method of claim 1, wherein the desired formulation further includes a predetermined quantity of diluent, the method further comprising the step of adding the predetermined quantity of diluent to the storage container.

* * * * *